US011531301B2

(12) United States Patent
Kubo et al.

(10) Patent No.: US 11,531,301 B2
(45) Date of Patent: Dec. 20, 2022

(54) CARTRIDGE INCLUDING A MEMBER MOVABLE RELATIVE TO A FRAME OF THE CARTRIDGE AND A REGULATING MEMBER FOR REGULATING MOVEMENT OF THE MOVABLE MEMBER

(71) Applicant: CANON KABUSHIKI KAISHA, Tokyo (JP)

(72) Inventors: Yukio Kubo, Tokyo (JP); Masanari Morioka, Kanagawa (JP); Naoki Hayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/126,212

(22) Filed: Dec. 18, 2020

(65) Prior Publication Data

US 2021/0109479 A1 Apr. 15, 2021

Related U.S. Application Data

(63) Continuation of application No. PCT/JP2019/025998, filed on Jun. 25, 2019.

(30) Foreign Application Priority Data

Jun. 25, 2018 (JP) ..... JP2018-120285
Jun. 21, 2019 (JP) ..... JP2019-115774

(51) Int. Cl.
*G03G 21/18* (2006.01)

(52) U.S. Cl.
CPC ..... *G03G 21/1864* (2013.01); *G03G 21/1814* (2013.01); *G03G 21/1846* (2013.01); *G03G 2221/1861* (2013.01)

(58) Field of Classification Search
CPC ..... G03G 21/1814; G03G 21/1842; G03G 21/1846; G03G 21/186; G03G 21/1864; G03G 2221/1846; G03G 2221/1861
See application file for complete search history.

(56) References Cited

U.S. PATENT DOCUMENTS 5,585,889 A * 12/1996 Shishido ..... G03G 21/1832 399/113
6,704,522 B2 3/2004 Sasago et al.
(Continued)

FOREIGN PATENT DOCUMENTS

CN 205485295 U 8/2016
CN 106647208 A 5/2017
(Continued)

OTHER PUBLICATIONS

International Search Report and Written Opinion for International Patent Application No. PCT/JP2019/025998, dated Jun. 25, 2019.

*Primary Examiner* — Sophia S Chen
(74) *Attorney, Agent, or Firm* — Venable LLP

(57) ABSTRACT

A cartridge includes a photosensitive drum and a coupling member for transmitting a driving force to the photosensitive drum. A movable member is provided movable relative to a frame and a rotatable portion is supported by the movable member and rotatable relative to the movable member. A regulating member is movable between a regulating position for regulating movement of the movable member by contacting the rotatable portion and a non-regulating position where the regulating member does not regulate the movable member. A position of an end portion of the movable member in an axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position. When the regulating member is in the regulating position, the movable member is constrained from moving from the first position to the second position, and, when the regulating member is in the non-regulating posi- (Continued)

tion, the movable member is permitted to move from the first position to the second position.

41 Claims, 18 Drawing Sheets

(56) References Cited

U.S. PATENT DOCUMENTS 6,714,746 B2 3/2004 Morioka et al.
6,898,399 B2 5/2005 Morioka et al.
6,937,832 B2 8/2005 Sato et al.
6,963,706 B2 11/2005 Morioka et al.
7,079,787 B2 7/2006 Ogino et al.
7,127,192 B2 10/2006 Batori et al.
7,200,349 B2 4/2007 Sato et al.
7,418,225 B2 8/2008 Morioka et al.
8,135,304 B2 3/2012 Abe et al.
8,270,876 B2 9/2012 Morioka et al.
8,275,286 B2 9/2012 Ueno et al.
8,280,278 B2 10/2012 Ueno et al.
8,295,734 B2 10/2012 Ueno et al.
8,422,914 B2 4/2013 Hayashi et al.
8,437,669 B2 5/2013 Morioka et al.
8,452,210 B2 5/2013 Ueno et al.
8,472,840 B2 6/2013 Abe et al.
8,478,166 B2 7/2013 Hara et al.
8,532,533 B2 9/2013 Ueno et al.
8,565,639 B2 10/2013 Nittani et al.
8,583,001 B2 11/2013 Kubo et al.
8,630,564 B2 1/2014 Ueno et al.
8,676,090 B1 3/2014 Ueno et al.
8,682,215 B1 3/2014 Ueno et al.
8,688,008 B2 4/2014 Norioka et al.
8,958,728 B2 * 2/2015 Hotani ..... G03G 15/0865 399/263
9,025,998 B2 5/2015 Morioka et al.
9,128,417 B2 9/2015 Yamasaki et al.
9,176,468 B2 11/2015 Ueno et al.
9,213,306 B2 12/2015 Morioka et al.
9,256,161 B2 2/2016 Hayashi et al.
9,274,499 B2 3/2016 Morioka et al.
9,280,121 B2 3/2016 Xiao et al.
9,377,716 B2 6/2016 Yamasaki et al.
9,429,906 B2 8/2016 Yoshimura et al.
9,465,318 B2 10/2016 Takeuchi et al.
9,483,016 B2 11/2016 Kashiide et al.
9,501,031 B2 11/2016 Hayashi et al.
9,523,942 B2 12/2016 Takeuchi et al.
9,632,451 B2 4/2017 Hayashi et al.
9,678,471 B2 6/2017 Ueno et al.
9,684,261 B2 6/2017 Miyabe et al.
9,703,257 B2 7/2017 Morioka et al.
9,733,614 B2 8/2017 Ueno et al.
9,746,826 B2 8/2017 Ueno et al.
9,772,602 B2 9/2017 Ueno et al.
9,785,091 B2 10/2017 Fukasawa et al.
9,817,333 B2 11/2017 Morioka et al.
9,836,015 B2 12/2017 Morioka et al.
9,836,020 B2 12/2017 Yoshimura et al.
9,836,021 B2 12/2017 Ueno et al.
9,841,724 B2 12/2017 Morioka et al.
9,841,727 B2 12/2017 Ueno et al.
9,841,728 B2 12/2017 Ueno et al.
9,841,729 B2 12/2017 Ueno et al.
9,846,408 B2 12/2017 Ueno et al.
9,851,685 B2 12/2017 Morioka et al.
9,851,688 B2 12/2017 Morioka et al.
9,851,691 B2 12/2017 Zeng et al.
9,857,764 B2 1/2018 Ueno et al.
9,857,765 B2 1/2018 Ueno et al.
9,857,766 B2 1/2018 Morioka et al.
9,864,331 B2 1/2018 Ueno et al.
9,864,333 B2 1/2018 Ueno et al.
9,869,960 B2 1/2018 Ueno et al.
9,874,846 B2 1/2018 Ueno et al.
9,874,854 B2 1/2018 Ueno et al.
9,886,002 B2 2/2018 Morioka et al.
9,904,242 B2 2/2018 Lin
9,939,776 B2 4/2018 Morioka et al.
9,989,892 B2 6/2018 Takeuchi et al.
10,133,215 B2 11/2018 Fukasawa et al.
10,168,664 B2 1/2019 Yoshimura et al.
10,168,665 B2 1/2019 Miyabe et al.
10,209,670 B2 2/2019 Ueno et al.
10,338,513 B1 7/2019 Hu et al.
10,386,751 B2 8/2019 Hayashi et al.
10,386,786 B2 8/2019 Sato et al.
10,401,788 B2 9/2019 Yoshimura et al.
10,429,794 B2 10/2019 Ueno et al.
10,520,887 B2 12/2019 Morioka et al.
10,539,923 B2 1/2020 Ueno et al.
10,539,924 B2 1/2020 Ueno et al.
10,551,793 B2 2/2020 Ueno et al.
10,585,391 B2 3/2020 Ueno et al.
10,591,868 B2 3/2020 Yoshimura et al.
10,620,582 B2 4/2020 Morioka et al.
10,671,018 B2 6/2020 Ueno et al.
10,705,481 B2 7/2020 Sugimoto et al.
10,712,709 B2 7/2020 Morioka et al.
10,712,710 B2 7/2020 Morioka et al.
10,788,789 B2 9/2020 Morioka et al.
10,788,790 B2 9/2020 Morioka et al.
10,795,312 B2 10/2020 Morioka et al.
10,816,931 B2 10/2020 Morioka et al.
11,003,125 B2 5/2021 Feng et al.
2011/0038649 A1 2/2011 Miyabe et al.
2013/0199510 A1 8/2013 Eto
2013/0308978 A1 11/2013 Nittani et al.
2013/0336674 A1 12/2013 Abe et al.
2014/0044459 A1 2/2014 Hotani
2014/0126930 A1 5/2014 Kashiide et al.
2015/0023692 A1 1/2015 Tanaka et al.
2015/0205254 A1 7/2015 Fujii et al.
2015/0277369 A1 10/2015 Okamoto et al.
2017/0108824 A1 4/2017 Kawakami et al.
2017/0261927 A1 9/2017 Sato et al.
2018/0164715 A1 1/2018 Kamochi et al.
2018/0067420 A1 3/2018 Tamura
2018/0356763 A1 12/2018 Ding et al.
2019/0079448 A1 3/2019 Miyabe et al.
2019/0391528 A1 12/2019 Ueno et al.
2020/0142353 A1 5/2020 Sato et al.
2020/0159165 A1 5/2020 Miyabe et al.
2020/0225616 A1 7/2020 Yoshimura et al.
2020/0249623 A1 8/2020 Sato et al.
2020/0249624 A1 8/2020 Ueno et al.
2020/0379405 A1 12/2020 Morioka et al.
2020/0401077 A1 * 12/2020 Luo ..... G03G 21/1864
2021/0041830 A1 2/2021 Ueno et al.
2021/0080903 A1 3/2021 Ueno et al.

FOREIGN PATENT DOCUMENTS

CN 108255042 A 7/2018
EP 3153933 A 4/2017
JP 2013-156589 A 8/2013
JP 2014-035388 A 2/2014
JP 2014-102406 A 6/2014
JP 2015-022181 A 2/2015
JP 2015-191173 A 11/2015
JP 2017-076114 A 4/2017
JP 2017-122896 A 7/2017
JP 2018-040954 A 3/2018
JP 2018-097067 A 6/2018
WO 2019007404 A 1/2019

* cited by examiner (a)

(b)

(a)

(b)

(c)

(a)

(b)

(a)

(b)

(a)

(b)

(a)

(b)

(c)

(a)

(b)

(a)

(b)

(a)

A-A (d)

(b)

B-B (e)

(c)

C-C (f)

(a)

(b)

CARTRIDGE INCLUDING A MEMBER MOVABLE RELATIVE TO A FRAME OF THE CARTRIDGE AND A REGULATING MEMBER FOR REGULATING MOVEMENT OF THE MOVABLE MEMBER

TECHNICAL FIELD

The present invention relates to a cartridge which can be mounted to or dismounted from an electrophotographic image forming apparatus.

BACKGROUND OF THE INVENTION

In a laser beam printer or a copying machine as an electrophotographic image forming apparatus, a toner image its formed on a photosensitive drum and the toner image is transferred onto a sheet as a recording material to form an image on the recording material.

In such an image forming apparatus, a method in which some portions of the image forming apparatus are provided in a cartridge, and the cartridge is taken out of the main assembly of the apparatus for maintenance or replacement is widely employed in order to facilitate maintenance. U.S. Pat. No. 9,904,242 discloses a structure for mounting a cartridge in an image forming apparatus.

SUMMARY OF THE INVENTION

Problem to be Solved

The present invention is for providing further development of the prior art.

Means for Solving the Problem

The present invention is a cartridge comprising a photosensitive drum; a coupling member for transmitting a driving force to said photosensitive drum; a frame rotatably supporting said photosensitive drum; a movable member movable relative to said frame; and a regulating member movable between a regulating position for regulating movement of said movable member by contacting said movable member and a non-regulating position not regulating said movable member, wherein a position of an end portion of said movable member in an axial direction of said photosensitive drum changes relative to said frame by movement of said movable member between a first position and a second position, and the end portion is closer to said coupling member in the axial direction when said movable member is in the second position than when said movable member is in the first position, and wherein when said regulating member in the regulating position, said movable member is constrained from moving from the first position to the second position, and when said regulating member is in the non-regulating position, said movable member is permitted to move from the first position to the second position, wherein said movable member is provided with a rotatable portion contacting said regulating member when said regulating member is in the regulating position.

Effect of the Invention

According to the present invention, the prior art can be further developed.

EMBODIMENTS OF THE INVENTION

Figure 1:
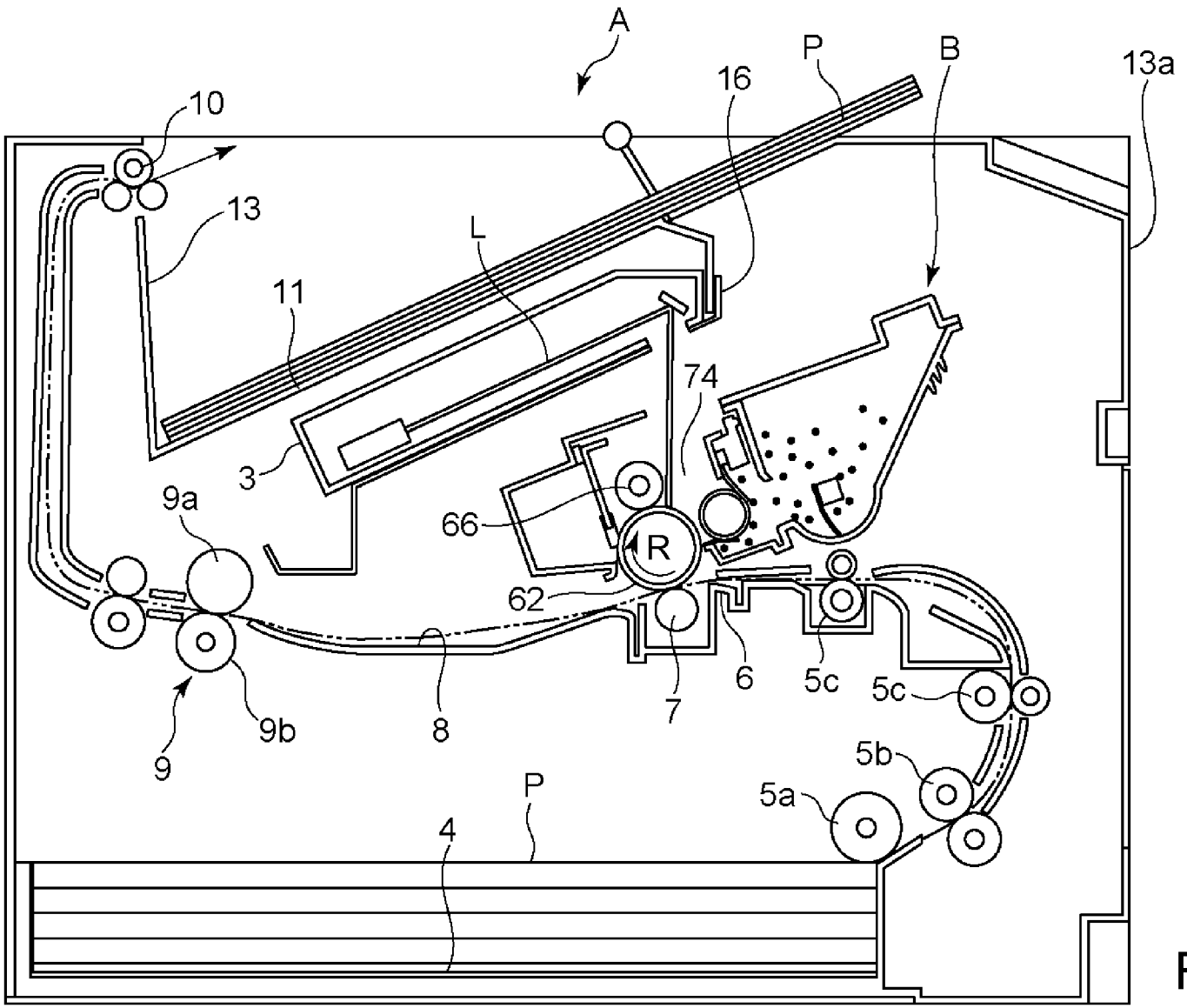
FIG. 1 is a cross-sectional view of an apparatus main assembly A and a cartridge B.

A cartridge and an electrophotographic image forming apparatus according to the present invention will be described with reference to the drawings. Hereinafter, a laser beam printer will be described as an example of the electrophotographic image forming apparatus, and a process cartridge usable with the laser beam printer will be described as an example of the cartridge.

In the following description, the longitudinal direction of the cartridge is a direction substantially perpendicular to the direction in which the cartridge is mounted to and dismounted from the main assembly of the electrophotographic image forming apparatus, is parallel to the rotation axis of the electrophotographic photosensitive member drum, and is a direction intersecting the feeding direction of the recording material. In the longitudinal direction, the side on which the electrophotographic photosensitive drum receives a rotational force from the image forming apparatus main assembly is a driving side (coupling member 63 side in FIG. 3), and the opposite side is a non-driving side.

Further, reference numerals in the description are for reference to the drawings, and do not limit the structure.

Embodiment 1

<Electrophotographic Image Forming Apparatus Structure and Image Forming Process>

Figure 2:
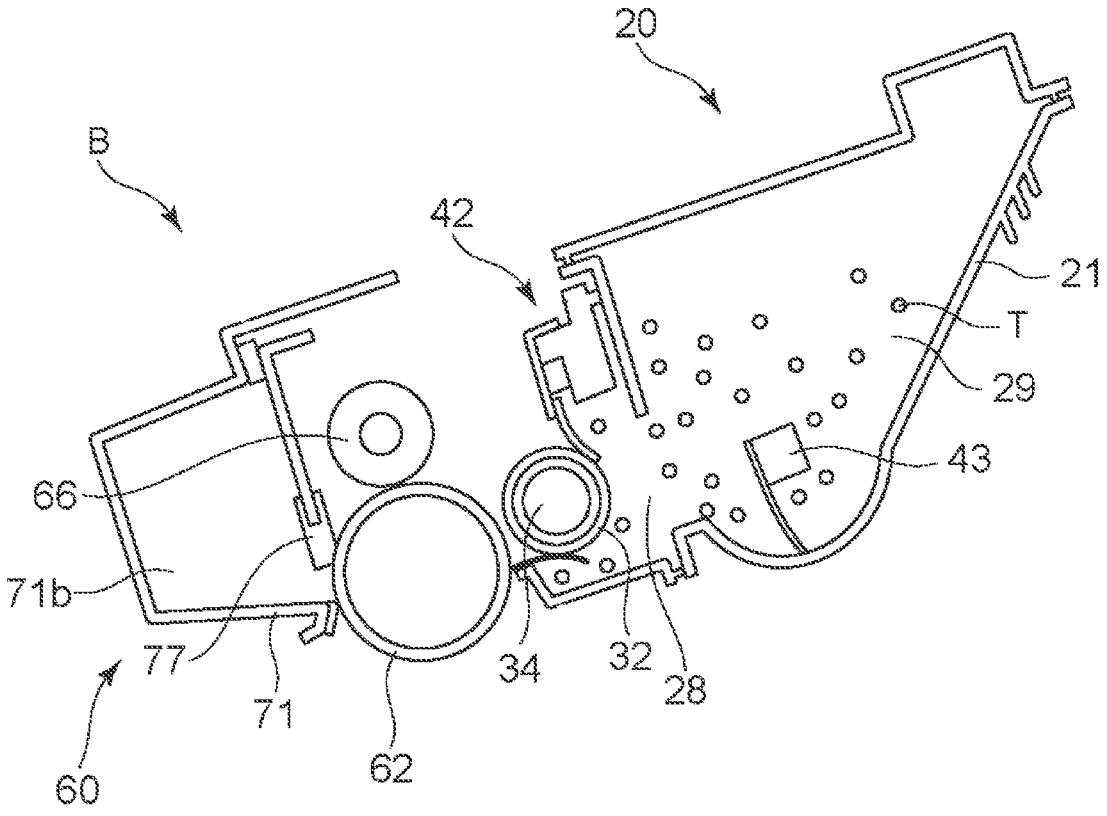
FIG. 2 is a cross-sectional view of the cartridge B.
Figure 4:
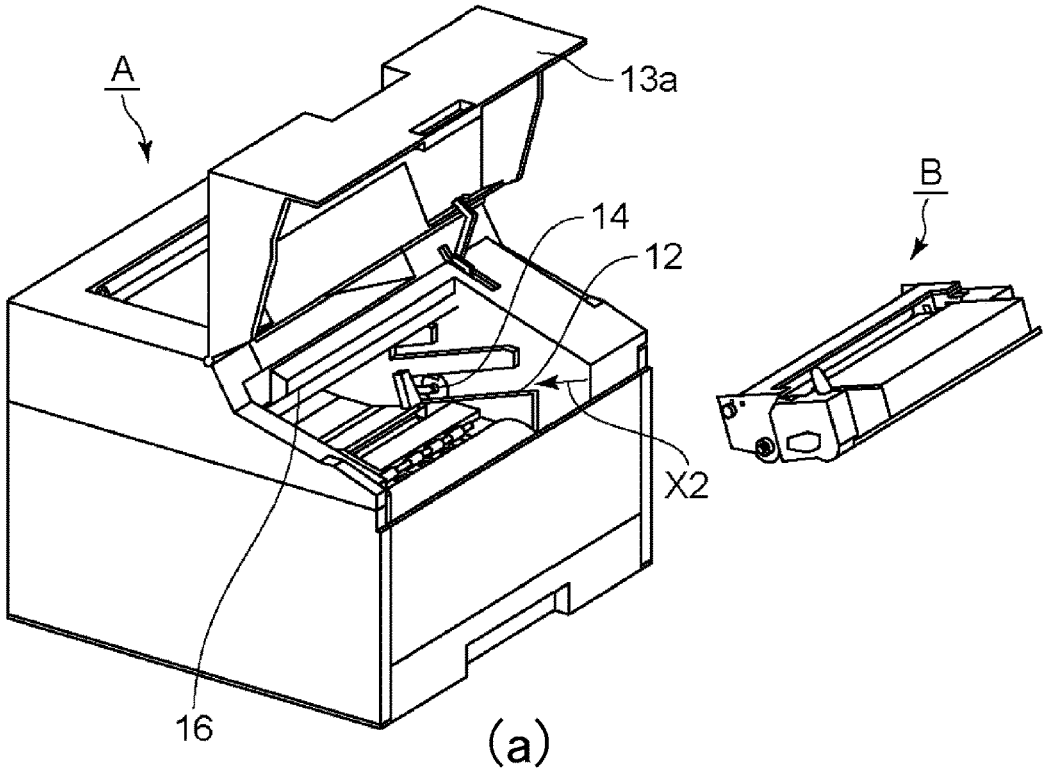
In FIG. 4, part (a) is a perspective views of an apparatus main assembly A and the cartridge B, and part (b) is a perspective view of the device main assembly A and the cartridge B.
Figure 4:
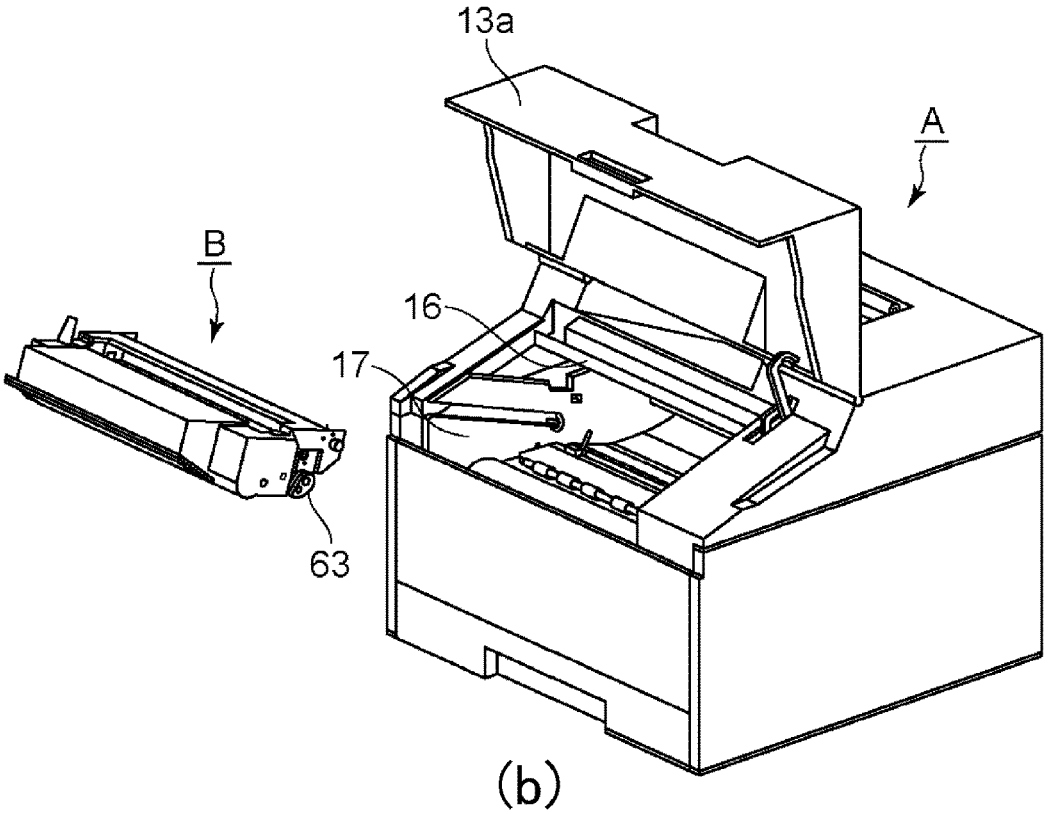

FIG. 1 is a cross-sectional view of an image forming apparatus main assembly A (hereinafter referred to as an apparatus main assembly A) and a process cartridge (hereinafter referred to as a cartridge B) of the electrophotographic image forming apparatus. FIG. 2 is a cross-sectional view of the cartridge B. Parts (a) and (b) of FIG. 4 are perspective views of the apparatus main assembly A and the cartridge B. Here, the apparatus main assembly A is a portion of the electrophotographic image forming apparatus except for the cartridge B.

Referring to FIGS. 1 and 4, the structure of the electrophotographic image forming apparatus will be described. The electrophotographic image forming apparatus shown in FIG. 1 is a laser beam printer using electrophotographic technology, in which the cartridge B can be mounted to and dismounted from the apparatus main assembly A. As shown in FIG. 4, the apparatus main assembly A has an exterior portion 13, a door 13*a*, a guide portion 12, a regulation release portion 16, and a guide surface 17, and the cartridge B is guided by the guide portion 12 and the guide surface 17 with the door 13*a* open to be mounted to and dismounted from the apparatus main assembly A.

When the cartridge B is mounted on the apparatus main assembly A, the coupling member 63 of the cartridge B engages with the driving shaft 14 provided on the apparatus main assembly A. It rotates about the rotation axis L5 of the driving shaft 14 (hereinafter referred to as the axis L5). Here, the direction parallel to the axis L5 in the apparatus main assembly A is Y direction.

Further, when the cartridge B is mounted to the apparatus main assembly A, the cartridge B is placed under the exposure device 3 (laser scanner unit). In addition, a sheet tray 4 containing recording materials (hereinafter referred to as sheets material P) to be subjected to the image formation is provided under the cartridge B. Further, the apparatus main assembly A includes a pickup roller 5*a*, a feeding roller pair 5*b*, a feed roller pair 5*c*, a transfer guide 6, a transfer roller 7, a feed guide 8, a fixing device 9, a discharge roller pair 10, a discharge tray 11, and the like are sequentially arranged along the feed direction D of the sheet material P. The discharge tray 11 is provided on the exterior portion 15 of the apparatus main assembly A. The fixing device 9 comprises a heating roller 9*a* and a pressure roller 9*b*.

Next, referring to FIGS. 1 and 2, the outline of the image formation process will be described. Based on the print start signal, the electrophotographic photosensitive member drum 62 (hereinafter, referred to as the drum 62), which is a rotatable member, is rotationally driven at a predetermined peripheral speed (process speed) in an arrow R direction. This is because the driving shaft 14 is rotationally driven and a driving force is transmitted to the coupling member 63, and the driving force is transmitted from the coupling member 63 (see FIGS. 3 and 4) to the drum 62.

The charging roller 66 to which the bias voltage is applied contacts the outer peripheral surface of the drum 62 and charges the outer peripheral surface of the drum 62 uniformly and uniformly. The exposure device 3 outputs a laser beam L in accordance with image information. The laser beam L passes through an exposure window portion 74 in the upper surface of the cartridge B, and scans and exposes the outer peripheral surface of the drum 62. By this, an electrostatic latent image corresponding to the image information is formed on the outer peripheral surface of the drum 62.

On the other hand, as shown in FIG. 2, in the developing unit 20 as a developing device, the developer (hereinafter referred to as "toner T") in the toner chamber 29 is stirred and fed by rotation of a feeding member 43, so that the toner is supplied into the toner supply chamber 28. The toner T is supported on the surface of a developing roller 32 by a magnetic force of a magnet roller 34 (stationary magnet). The toner T is triboelectrically charged by a developing blade 42, and a layer thickness of the peripheral surface of a developing roller 32 is regulated. The feed member 43 and the developing roller 32 rotate by transmission of a driving force from the coupling member 63 (see FIGS. 3 and 4).

The toner T carried on the surface of the developing roller 32 is transferred (supplied) to the drum 62 in accordance with the electrostatic latent image, and is visualized into a toner image. That is, the drum 62 carries toner (toner image) and rotates.

Further, as shown in FIG. 1, the sheet material P stored in the lower portion of the apparatus main assembly A is fed from the sheet tray 4 by the pickup roller 5*a*, the feeding roller pair 5*b*, and the feed roller pair 5*c* in timed relation with the output timing of the laser beam L. Then, the sheet material P is supplied to a transfer position between the drum and the transfer roller 7 by way of the transfer guide 6. At this transfer position, the toner image is sequentially transferred from the drum 62 to the sheet material P.

The sheet material P onto which the toner image has been transferred is separated from the drum 62 and fed to the fixing device 9 along the feeding guide 8. Then, the sheet material P passes through a nip portion of the heating roller 9*a* and the pressing roller 9*b* constituting the fixing device 9. Pressure and heat fixing process is performed at this nip portion, and the toner image is fixed on the sheet material P. The sheet material P which has been subjected to the toner image fixing process is fed to the discharge roller pair 10 and is discharged to the discharge tray 11.

On the other hand, as shown in FIG. 2, the drum 62 after transfer is used again in the image forming process after the residual toner on the outer peripheral surface is removed by the cleaning blade 77. The toner removed from the drum 62 is stored in a waste toner chamber 71*b* of a cleaning unit 60.

In the above description, the charging roller 66, the developing roller 32, and the cleaning blade 77 are process means actable on the drum 62.

<Structure Cartridge B>

Figure 3:
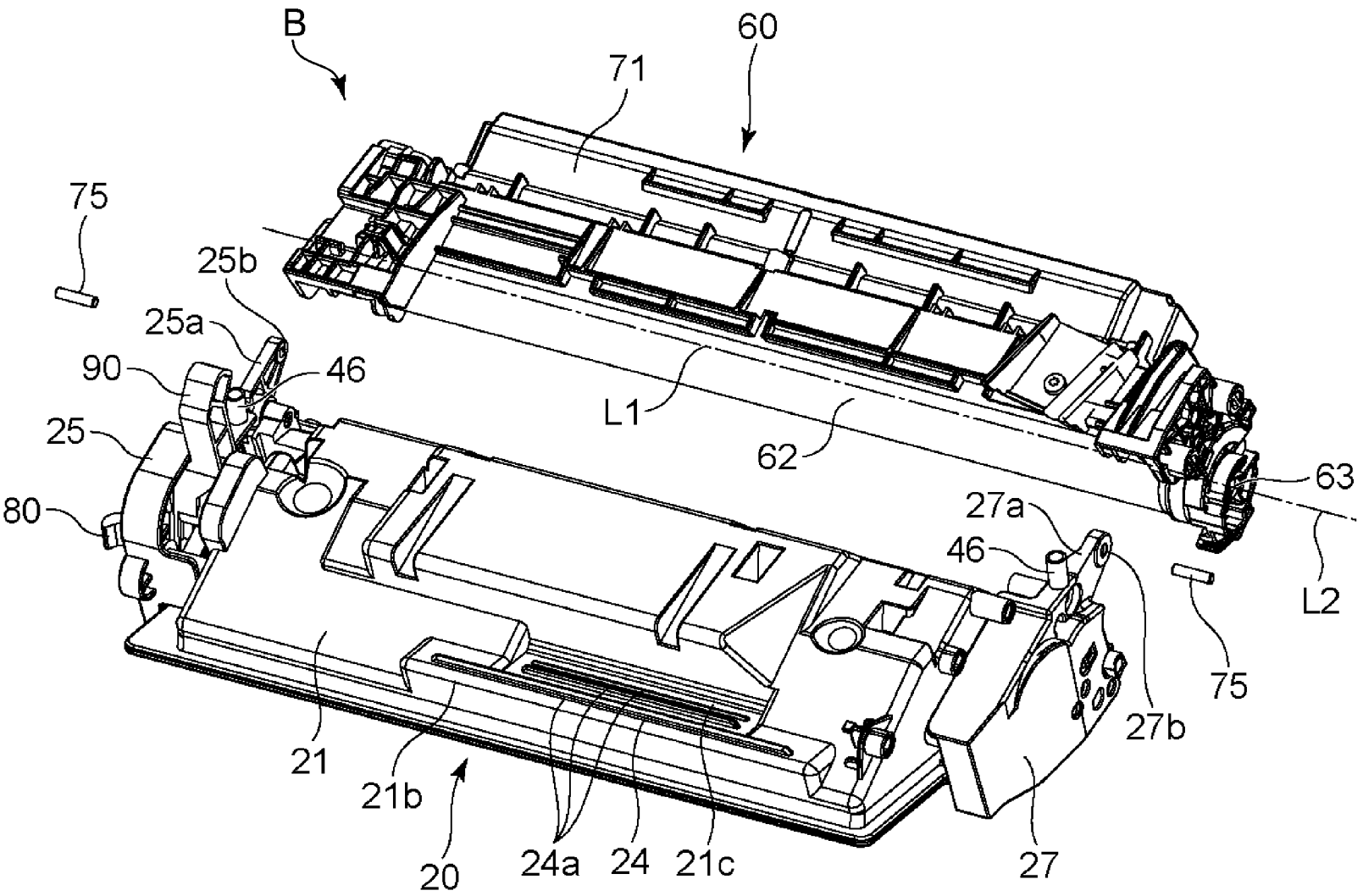
FIG. 3 is an exploded perspective view of the cartridge B.

Next, referring to FIGS. 2 and 3, the overall structure of the cartridge B will be described. FIG. 3 is an exploded perspective view of the cartridge B. The cartridge B is constituted by combining the cleaning unit 60 and the developing unit 20.

The cleaning unit 60 includes a cleaning frame 71, the drum 62, the charging roller 66, the cleaning blade 77, and the like.

Here, a flange 64 is fixed to the drive side end of the drum 62, and the coupling member 63 is fixed to the flange 64. Here, the drum 62 can rotate about a rotation axis L1 (hereinafter referred to as axis L1) as the drum axis. In addition, the coupling member 63 can rotate about a rotation axis L2 (hereinafter referred to as an axis L2) as a coupling axis. The axis L2 coaxial with the axis L1.

On the other hand, the developing unit 20 includes a toner accommodating container 21, a first side cover 25, a second side cover 27, the developing blade 42, the developing roller 32, the magnet roller 34, the feed member 43, toner T, a spring 46, and so on. The toner is stored in the toner accommodating container 21, and the first side cover 25 and the second side cover 27 are fixed with screws, respectively. In addition, the toner accommodating container rotatably supports the developing roller 32 and the feed member 43, and the developing blade 42 is fixed with screws.

The cartridge B is formed by rotatably connecting the cleaning unit 60 and the developing unit 20 with each other by a coupling pin 75. The cleaning frame 71, the toner storage container 21, the first side cover 25, and the second side cover 27 constitute the frame of the cartridge B. In addition, as will be understood from FIG. 3, parts (a) and (b) of FIG. 5, parts (a) and (b) FIG. 9. A grip portion is provided for the user to grip when the user mounts the cartridge B into the apparatus main assembly. Further, on the frame (toner accommodating container 21) of the cartridge B, a projecting portion 21*b* projecting from the outer surface (upper surface) of the frame of the cartridge B and a recess portion 21*c* recessed from the outer surface (upper surface) of the frame of the cartridge B are provided. The grip portion 24 is structured to include at least portions of the surfaces of the projections 21*b* and recess 21*c*. The projection 21*b* and the recess 21*c* provides a shape (thickness) for making it easy for the user to grip the grip portion 24 to hold the frame of the cartridge B. Furthermore, the grip portion 24 has an elongated shape in the longitudinal direction of the cartridge B (the axial direction of the drum 62 or the developing roller 32). Therefore, it is easy for the user to grip the grip portion 24 and move the cartridge B in a direction perpendicular to or intersecting the axial direction of the drum 62 or the developing roller 32. Moreover, a non-slip shaped portion 24*a* is provided on the surface portion (grip portion zone) constituting the grip portion 24 of the projections 21*b* and the recesses 21*c*. The non-slip shaped portion 24*a* makes it difficult for the grip portion 24 to slip off from the user's hand by being caught by the user's fingers when the user grips the grip portion 24. In this embodiment, the non-slip shaped portion 24*a* includes a plurality of linear rib-shaped portions extending in parallel with each other, and the extending direction crosses with the inserting direction X2 of the cartridge B into the apparatus main body A (parts (a) and (b) of FIG. 9). However, the shape of the non-slip shape portion 24*a* is not limited to the above-described example, and may include a plurality of projections arranged in dots, and may be recesses arranged in dots or straight lines, for example, instead of projections. Further, the non-slip shaped portion 24*a* may be provided on the surface of the frame of the cartridge B without providing the projecting portion 21*b* or the recess portion 21*c*. In such a case, the region provided with the non-slip shape portion 24*a* on the surface of the frame of the cartridge B is the surface portion (grip portion region) constituting the grip portion 24.

More specifically, holes 25*b* and 27*b* extending in parallel with the developing roller 32 are provided in tips of arm portions 25*a* and 27*a* of the first side cover 25 and the second side cover 27 at respective ends in the longitudinal direction of the developing unit 20 (the axial direction of the developing roller 32).

Further, fitting holes for fitting the coupling pins 75 are formed in each of the longitudinal end portions of the cleaning frame 71.

Then, by aligning the arm portions 25*a* and 27*a* with the predetermined positions of the cleaning frame 71 and inserting the coupling pins 75 into the rotating holes 25*b* and 27*b* and the fitting hole, the cleaning unit 60 and the developing unit 20 are connected with each other so as to be rotatable about the coupling pin 75.

At this time, the springs 46 mounted on the base portions of the arm portions 25*a* and 27*a* abut the cleaning frame 71, and the developing unit 20 is urged toward the drum 62 by the developing unit 20 being urged toward the cleaning unit 60 about the coupling pin 75. Here, since ring-shaped spacing members (not shown) are mounted to the respective ends in the axial direction of the developing roller 32, the spacing members contacts the drum to maintain a predetermined gap between the developing roller 32 and the drum 62.

<Cartridge Tilt Unit C>

Figure 5:
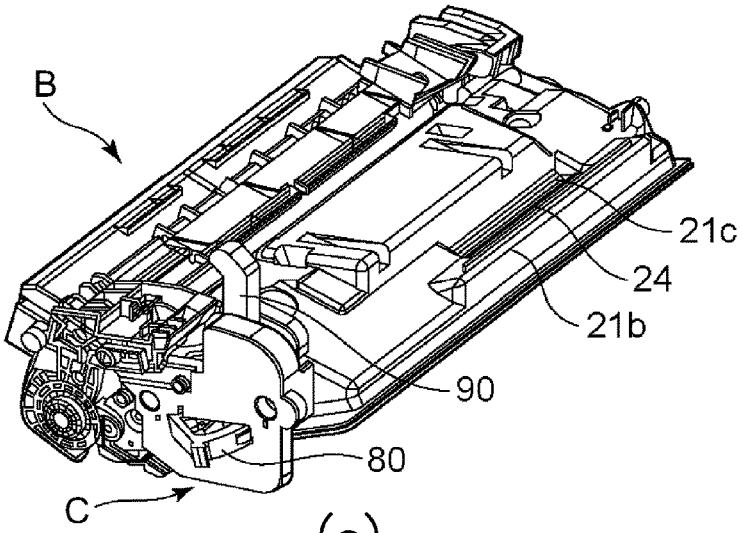
In FIG. 5, part (a) is a perspective view of the cartridge B, part (b) is a perspective view of the toner storage container 21 with the first side cover 25 removed, and part (c) is a perspective view of a cartridge tilting unit C.
Figure 5:
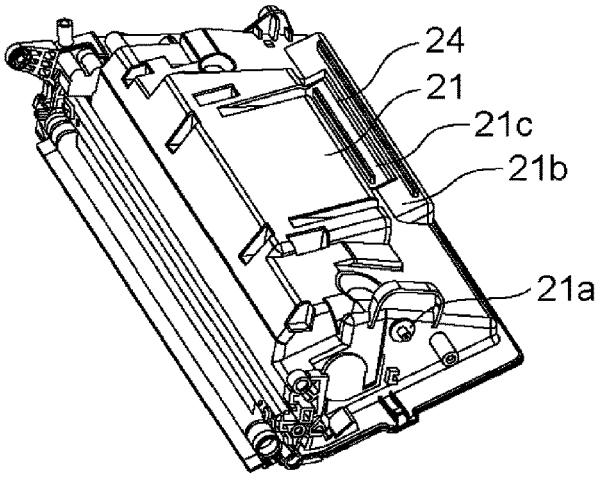
Figure 5:
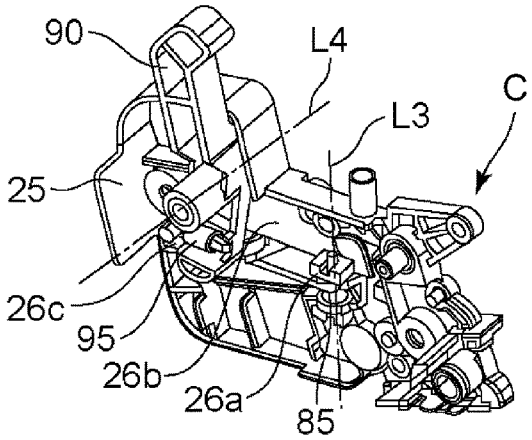
Figure 6:
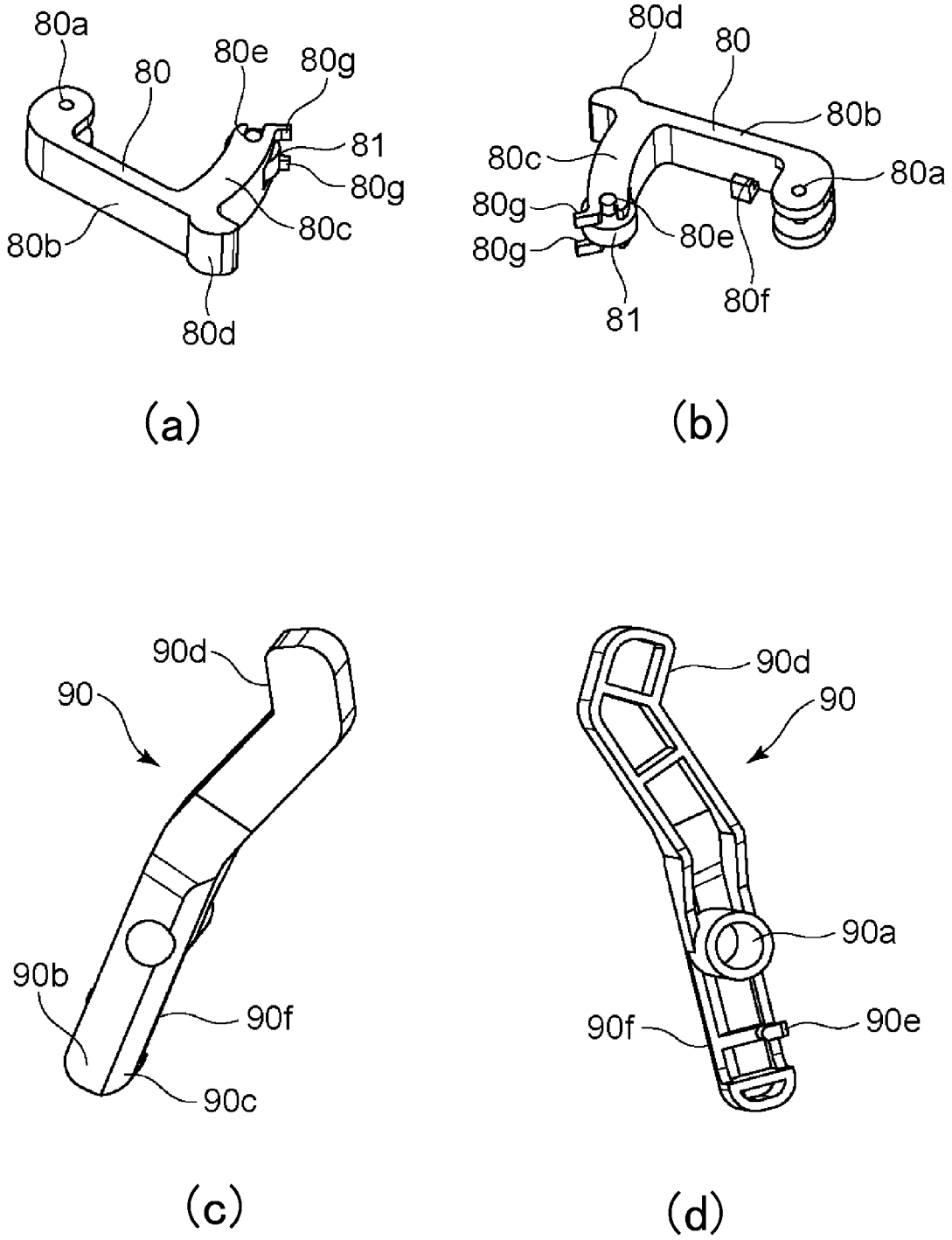
In FIG. 6, part (a) is a perspective view of a movable guide member 80, part (b) is a perspective view of the movable guide member 80, part (c) is a perspective view of a regulation lever 90, and part (d) is a perspective view of the regulation lever 90.

Next, the cartridge tilting unit C included in the cartridge B will be described. First, the structure of the cartridge tilting unit C will be described referring to FIGS. 5 and 6. Part (a) of FIG. 5 is a perspective view of the cartridge B, part (b) of FIG. 5 is a perspective view of the toner accommodating container 21 with the first side cover 25 removed, and part (c) of FIG. 5 is a perspective view of the cartridge tilting unit C. Parts (a) and (b) FIG. 6 are perspective views of the movable guide member 80, and parts (c) and (d) of FIG. 6 are perspective views of a regulation lever 90.

The cartridge tilting unit C mainly has a movable guide member 80 and a regulation lever (regulation member) 90. The movable guide member 80 and the regulation lever 90 form a portion of the frame of the cartridge B. The cartridge tilting unit C is for tilting the axis L2 of the coupling member 63 with respect to the rotation axis L5 of the main assembly driving shaft by tilting the cartridge B when the cartridge B is mounted on the apparatus main assembly A.

In the movable guide member (moving member) 80, a supported portion 80*a* is rotatably supported by a support shaft 26*a* of the first side cover 25. The rotation axis (hereinafter referred to as axis L3) is perpendicular to the axis L1 and the axis L2 (see FIG. 3). The movable guide member 80 includes a guided portion 80*d* which contacts the guide surface 17 of the apparatus main assembly A, and a roller supporting portion 80*e* which supports a roller (rotating portion) 81. In addition, the movable guide member 80 includes a first arm 80*b* connecting the supported portion 80*a* and the guided portion 80*d* with each other, a second arm 80*c* connecting the guided portion 80*d* and the roller supporting portion 80*e* with each other, and a spring contact portion 80*f* provided on the first arm 80 and abutted to by the first spring 85. Further, at the free end of the second arm 80*c*, a positioned portion 80*g* which contacts a movable guide positioning portion (not shown) provided on the back surface 26*b* of the first side cover 25 is provided. The second arm 80*c* is a rod portion including an arcuately curved shape centered on the axis L3.

The regulating lever (regulating member) 90 is rotatably supported by the support shaft 21*a* of the toner accommodating container 21 at the supported portion 90*a*. The rotation axis L4 (hereinafter referred to as the axis L4) is parallel to the axis L1 and the axis L2 (see FIG. 3), and is not parallel to the axis L3 (in a twisted position). The regulation lever 90 includes a regulation surface (first surface) 90*b* which contacts the roller 81, an inclined surface (second surface) 90*c* provided next to the regulation surface (first surface) 90*b*, and a main assembly contact portion 90*d* which contacts the regulation release portion of the device main assembly A. The regulation surface 90*b* is perpendicular to the axis L4, and the inclined surface 90*c* is a surface inclined with respect to the regulation surface 90*b* and the axis L4. In addition, the regulation lever 90 is provided with a spring contact portion (pressed portion) 90*e* to which the second spring 95 abuts, and a positioned portion 90*f* which contacts the regulation lever positioning portion 26*c* of the first side cover 25.

The first side cover 25 includes the support shaft 26*a* described above, a back surface 26*b* including a movable guide positioning portion (not shown), and a regulation lever positioning portion 26*c*. Further, the first side cover 25 includes a first spring locking portion 26*d* for locking the first spring 85, a second spring locking portion 26*e* for locking the second spring 95, and a guide rib 26*f* for guiding the regulation lever 90. At least a portion of the guide rib 26*f* is provided at a position projecting from a surface supporting the spring 46 or an extended virtual surface 25*c* in the Z direction parallel to the axis L3.

Figure 7:
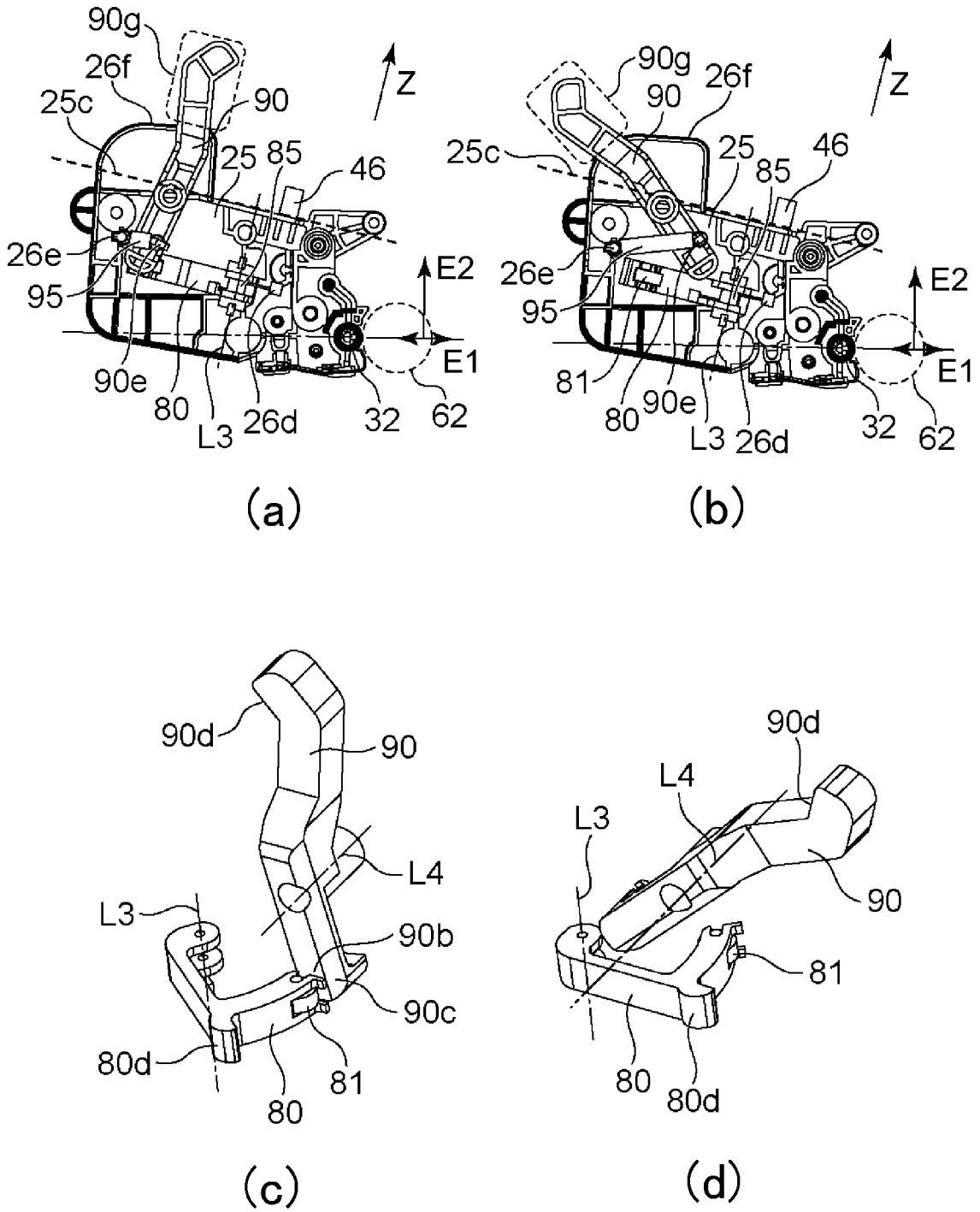
In FIG. 7, part (a) is a view of the cartridge tilting unit C along the axis L4, part (b) is a view of the cartridge tilting unit C taken along the axis L4, and part (c) is a perspective view illustrating the relationship between the movable guide member 80 and the regulation lever 90, and part (d) is a perspective view illustrating the relationship between the movable guide member 80 and the regulation lever 90.
Figure 8:
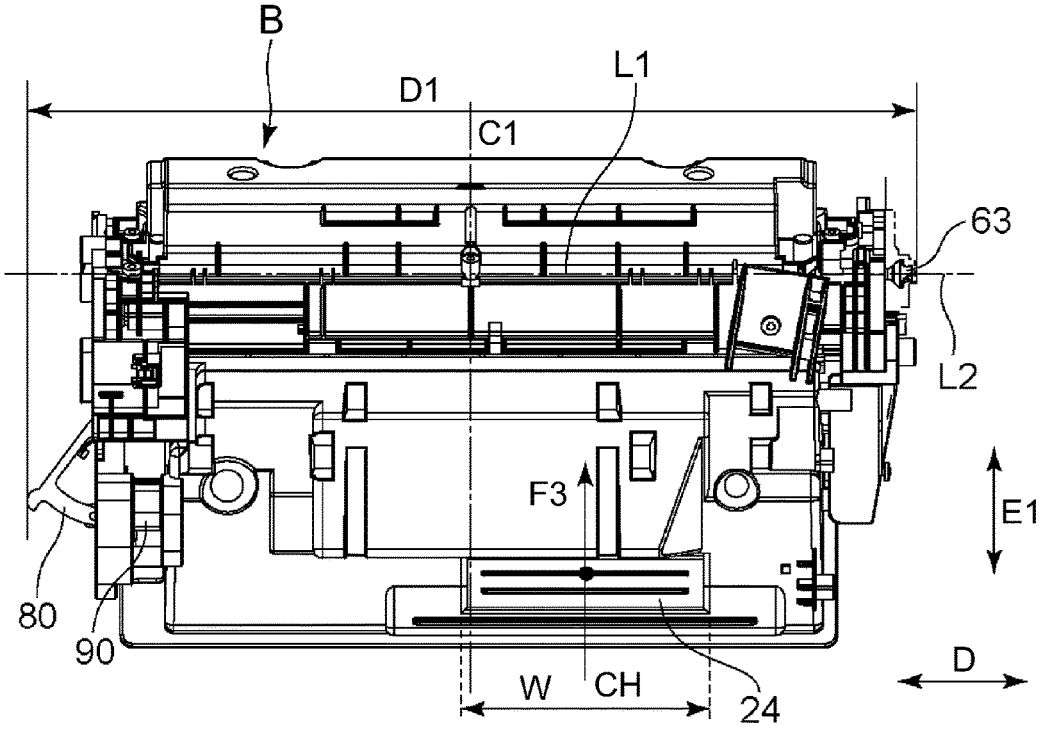
In FIG. 8, part (a) is a view of the cartridge B and the cartridge tilting unit C taken along the direction parallel to the axis L3, and part (b) is a view of the cartridge B and the cartridge tilting unit C taken along the direction parallel to the axis L3.
Figure 8:
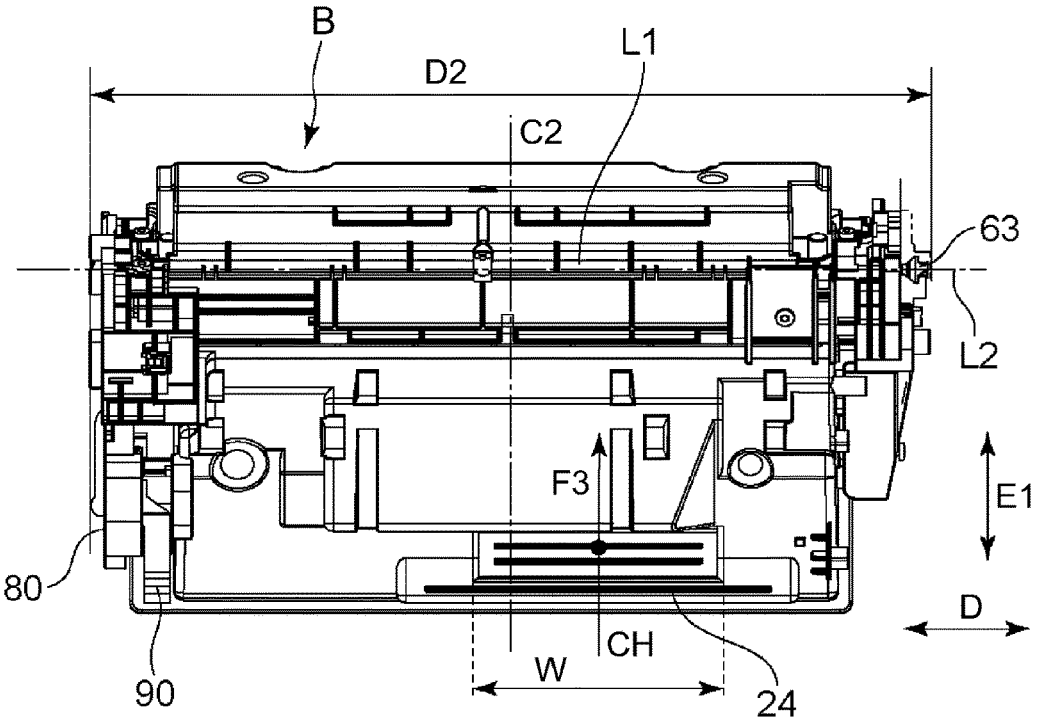

Next, referring to FIGS. 7 and 8, the operation of the cartridge tilting unit C will be described. Part (a) of FIG. 7 and part (b) of FIG. 7 are illustrations of the cartridge tilting unit C as viewed along the axis L4, and part (c) of FIG. 7 and part (d) of FIG. 7 are perspective views showing a relationship between the movable guide member 80 and the regulation lever 90. part (a) of FIG. 8 and part (b) of FIG. 8 are illustrations of the cartridge B and the cartridge tilting unit C as viewed along a direction parallel to the axis L3. Here, in part (a) of FIG. 8 and part (b) of FIG. 8, a part of the cleaning frame 71 is shown through, in order to clearly show the position of the coupling member 63.

The cartridge tilting unit C can be in a projecting state and in a retracted state. The projecting state is the state shown in part (a) of FIG. 7, part (c) of FIG. 7, and part (a) of FIG. 8, in which the movable guide member 80 is in the first position and the guided portion 80*d* is away from the coupling member 63 in the D direction parallel to the axis L1. A distance between the outermost end of the guided portion 80*d* and the outermost end of the coupling member 63 in the D direction when the movable guide member 80 is in the first position is D1.

The retracted state is the state shown in part (b) of FIG. 7, part (d) of FIG. 7, and part (b) of FIG. 8, when the movable guide member 80 is in the second position in which the guided portion 80*d* is in a position closer to the coupling member 63 in the D direction than when the movable guide member 80 is in the first position. A distance between the outermost end of the guided portion 80*d* and the outermost end of the coupling member 63 in the D direction when the movable guide member 80 is in the second position is D2.

The movable guide member 80 moves between the first position and the second position by rotating (moving) about the axis L3, and with this, the position of the guided portion 80*d* is also displaced. The movable guide member 80 is urged in the direction away from the second position toward the first position by the force received from the first spring 85 at the spring contact portion 80*f* Therefore, in a state where the cartridge B is not mounted on the apparatus main assembly A and is not subjected to an external force, the movable guide member 80 is positioned by the positioned portion 80*g* being abutted to the movable guide positioning portion (not shown) by the urging force of the first spring 85. At this time, it can be said that the movable guide member 80 is in the first position and the cartridge tilting unit C is in the projecting state.

On the other hand, the regulation lever 90 can move between the regulated position and the non-regulated position by rotating (moving) around the axis L4. When the movable guide member 80 is in the first position, the regulation lever 90 can be located in the regulation position. The description will be made as to the case in which the movable guide member 80 receives an external force and tends to rotate toward the second position against the urging force of the first spring 85, when the movable guide member 80 is in the first position and the regulation lever 90 is in the regulation position. At this time, the roller 81 supported by the movable guide member 80 contacts the regulation surface 90*b* of the regulation lever 90, and therefore, the movement of the movable guide member 80 from the first position to the second position is restricted.

The regulation lever 90 moves between the regulated position and the non-regulated position by rotating (moving) about the axis L4. Therefore, by the regulation lever 90 moving from the regulated position to the non-regulated position, the restriction on the rotations of the roller 81 and the movable guide member 80 by the regulation surface 90*b* is removed to permit the rotation of the movable guide member 80 from the first position to the second position.

The regulation lever 90 is pressed by the second spring 95 at the spring contact portion 90*e*, and is urged in the direction from the non-regulation position to the regulation position by the force received from the second spring 95. Therefore, in a state where the cartridge B is not mounted on the apparatus main assembly A and is not subjected to an external force, the positioned portion 90*f* of the regulation lever 90 abuts against the regulation lever positioning portion 26*c* by the urging force of the second spring 95 so that the regulation lever 90 is positioned at the regulated position.

As will be described in detail hereinafter, in the process of mounting the cartridge B to the device body A, the main assembly contact portion 90*d* receives a force from the regulation release portion of the apparatus main assembly A, by which the regulation lever 90 can move from the regulated position to the non-regulated position.

When the movable guide member 80 is in contact with the movable guide positioning portion (not shown) and is positioned there, and the regulation lever 90 is in contact with the regulation lever positioning portion 26*c* and is positioned there, a gap formed between the movable guide member 80 and the roller 81 and the regulation lever. Therefore, the movable guide member 80 can move toward the second position within the range of the above-described gap until the movable guide member 80 moves toward the second position by an external force and the roller 81 abuts on the regulation surface 90*b*. It can be said that the movable guide member 80 is in the first position even when the movable guide member 80 is in any position within this range (regulation range), that is, the movement to the second position is restricted by the regulation lever 90.

<Position of Grip Portion 24>

Next, the position of the grip portion 24 provided on the cartridge B will be described. As shown in FIG. 8, the position of the center of the grip portion 24 in the D direction is defined as the center position CH. The center position CH is the center position of the width W of the grip portion 24 in the D direction. In addition, the center position of the width D1 of the cartridge B in the projecting state is defined as the center position C1, and the center position of the width D2 of the cartridge B in the retracted state is defined as a center position C2. Here, the width D1 of the cartridge B with respect to the D direction in the projecting state corresponds to the following distance. That is, as shown in part (a) of FIG. 8, the width D1 is from the left end (left end of the cartridge B) of the frame (movable guide member 80) of the cartridge B to the right end (right end of the cartridge B) of the frame (cleaning frame 71) of the cartridge B in the D direction. Further, the width D2 of the cartridge B with respect to the D direction in the retracted state corresponds to the following distance. That is, as shown in part (b) of FIG. 8, the width D2 corresponds to the distance from the left end (left end of the cartridge B) of the cartridge B frame (cleaning frame 71) to the right end (right end of the cartridge B) the cartridge B frame (cleaning frame) in the D direction.

Here, in the D direction, the coupling member 63 is placed on the right side (driving side) in FIG. 8 with respect to the center positions C1 and C2, and therefore, it is placed at a position closer to the right side (driving side) than to the left (non-driving side) of the cartridge B in FIG. 8. In both the projecting state and the retracted state, the center position CH in the D direction is closer to the right end (one end) of the cartridge B on the right side (drive side) than the center position C1 and the center position C2 of the cartridge B. In other words, in the D direction, the center position CH is arranged closer to the right end (one end) of the cartridge B than the left end (non-driving side) end (other end) of FIG. 8. In addition, in the D direction, it can be said that the center position CH is arranged on the side (driving side) where the coupling member 63 is arranged rather than the center position C1 and the center position C2. Further, in the D direction, the movable guide member 80 is arranged on the left side (non-driving side), in FIG. 8, of the center positions C1 and C2 in both the projecting state and the retracted state. Therefore, in the D direction, it can be said that the center position CH is arranged on the side (non-driving side) where the movable guide member 80 is not arranged, with respect to the center positions C1 and C2.

Figure 18:
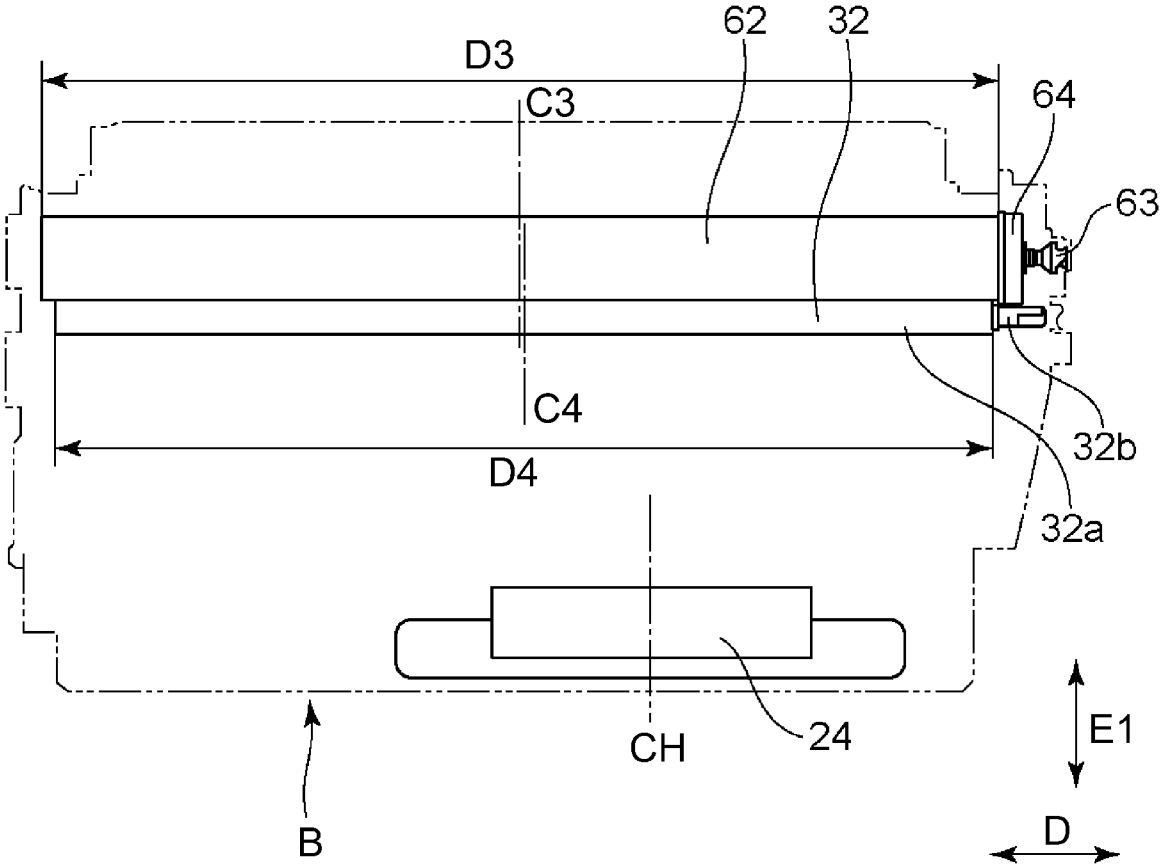
FIG. 18 is a view of the cartridge B as viewed along the direction parallel to the axis L3.

The arrangement relationship of the grip portion 24 and the coupling member 63 in the D direction is the same even when the width D3 of the drum 62 is used as a reference. FIG. 18 is a view of the cartridge B along the direction parallel to the axis L3, and shows the outer appearance of the frame of the cartridge B and the arrangement relationship of the drum 62, the developing roller 32, and the grip portion 24 for explanation. Here, the width D3 of the drum 62 is the width of the cylinder portion 62*a* to which the flange 64 of the drum 62 is fixed. As shown in FIG. 18, the center position of the width D3 of the drum 62 is defined as the center position C3. The center position C3 does not change irrespective of the change between the projecting state and the retracted state. Here, in the D direction, the coupling member 63 is arranged on the right side (driving side) in FIG. 18 with respect to the center position C3, and therefore, it is placed at a position closer to the end (one end) on the right side (drive side) than to the end (other end) of the cartridge B on the left side (non-driving side) of FIG. 18. In addition, in the D direction, it can be said that the center position CH is placed on the side (driving side) where the coupling member 63 is provided with respect to the center position C3. Such a relationship is the same even if the center position C3 is the center position of the width including the width D4 of the drum 62 plus the flange 64. Further, the above relationship is the same even if the center position C3 is replaced with the center position C4 which is the center position of the width D4 of the developing roller 32. The width D4 of the developing roller 32 is shown as the width of the large-diameter portion of the sleeve portion 32*a* of the developing roller 32 in FIG. 18, but the above relationship remains the same even if the width includes the small-diameter portion of the core metal 32*b*.

<Mounting of Cartridge B to Apparatus Main Assembly A>

Figure 10:
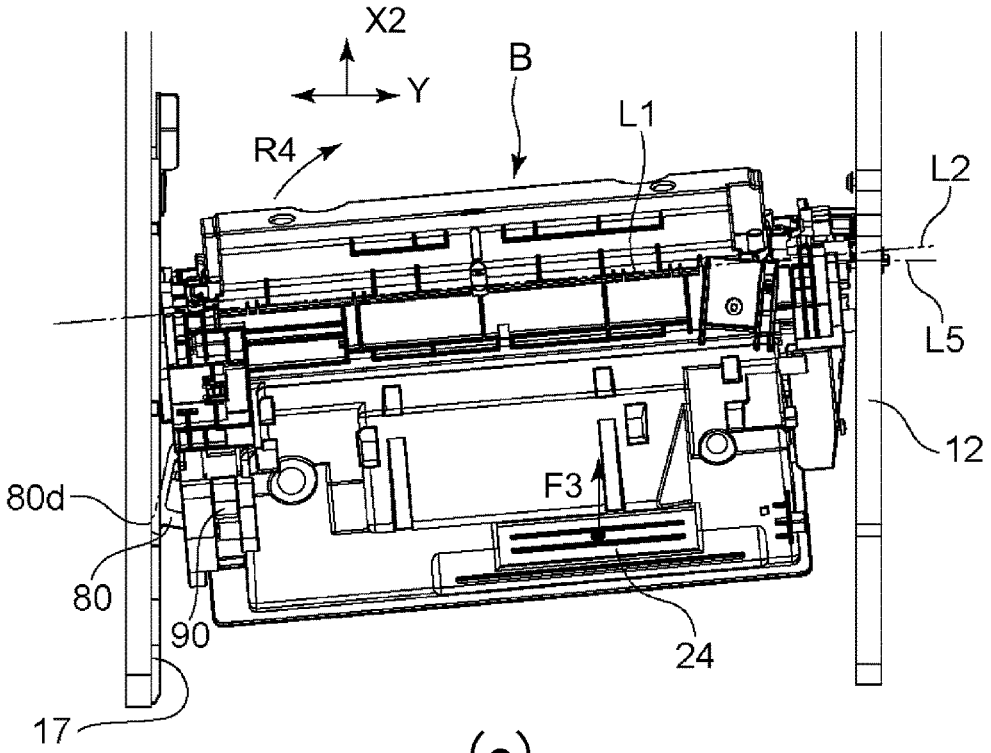
In FIG. 10, part (a) is a top plan view of the cartridge B and the apparatus main assembly A, and (b) is a top plan view of the cartridge B and the apparatus main assembly A.
Figure 10:
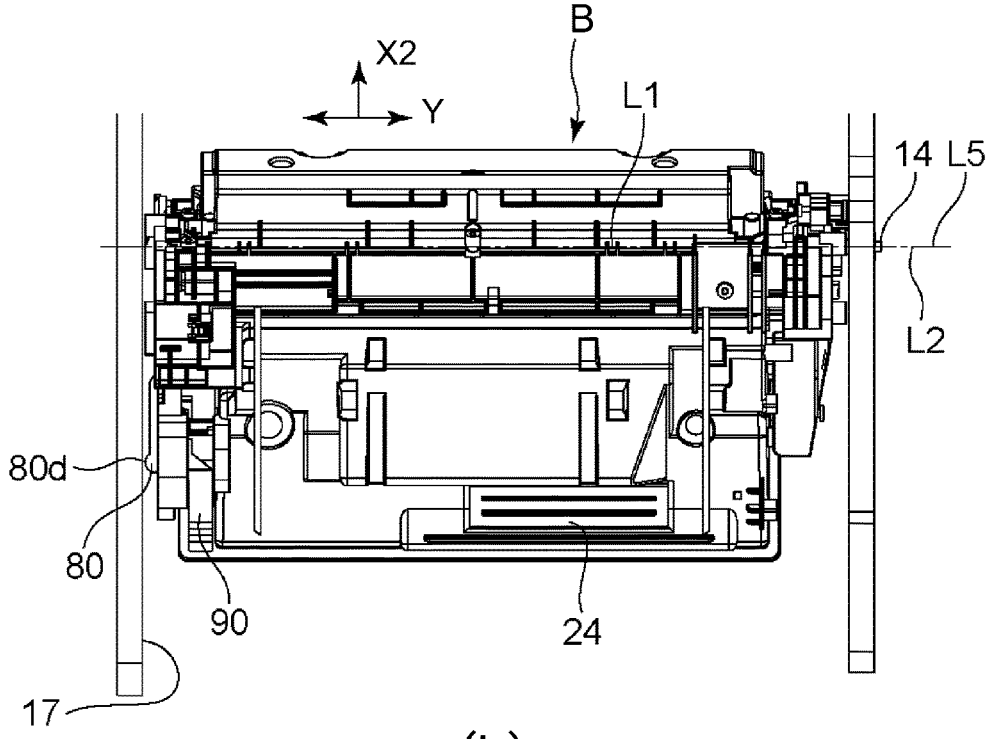
Figure 11:
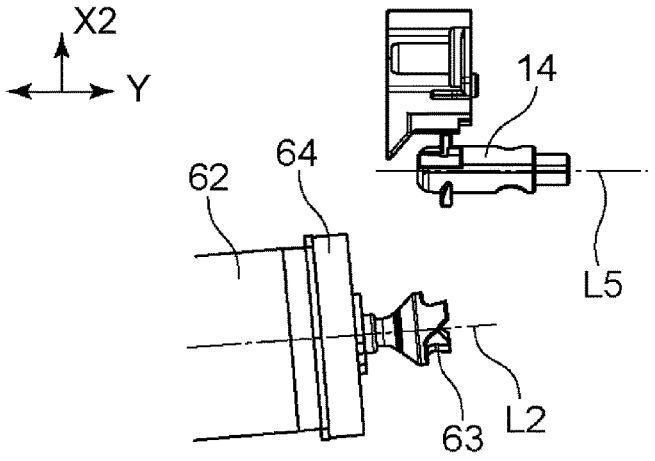
In FIG. 11, part (a) is a top view of a coupling member 63 and a main assembly driving shaft 14, part (b) is a top view of the coupling member 63 and the main assembly driving shaft 14, and part (c) is a top view of the coupling member 63 and the main assembly.
Figure 11:
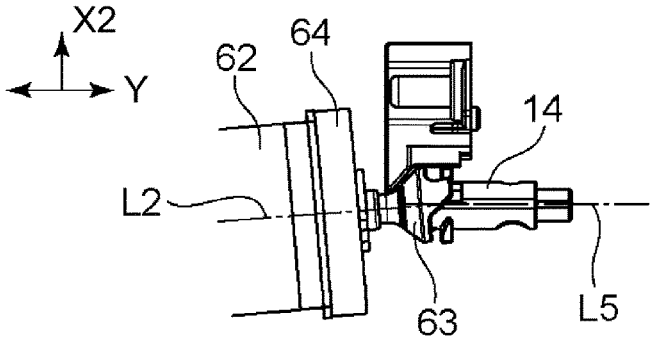
Figure 11:
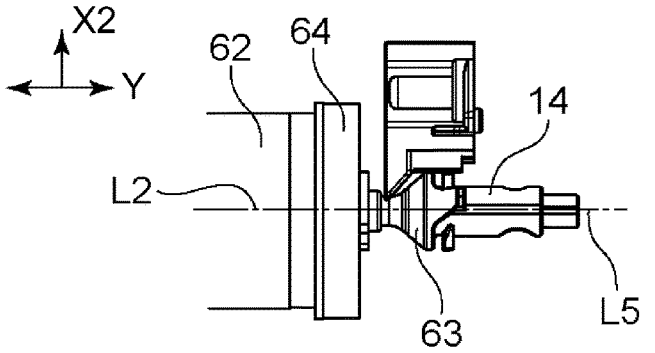
Figure 12:
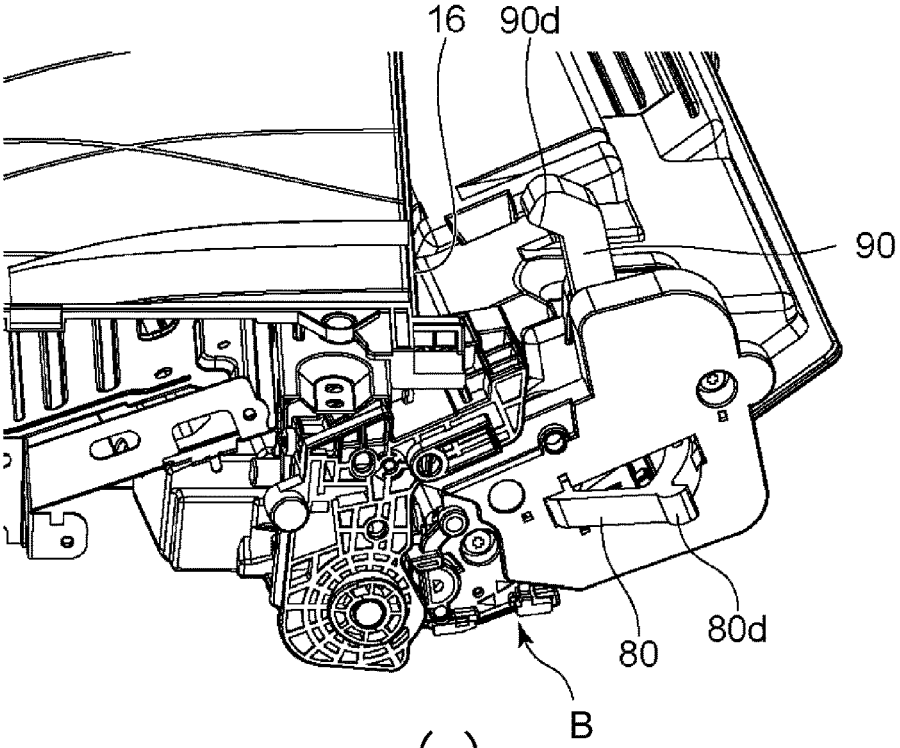
In FIG. 12, part (a) is a perspective view of a neighborhood of the cartridge tilting unit C of the cartridge B as viewed from a non-driving side, and part (b) is a perspective view of a neighborhood of the cartridge tilting unit C of the cartridge B as viewed from the non-driving side.
Figure 12:
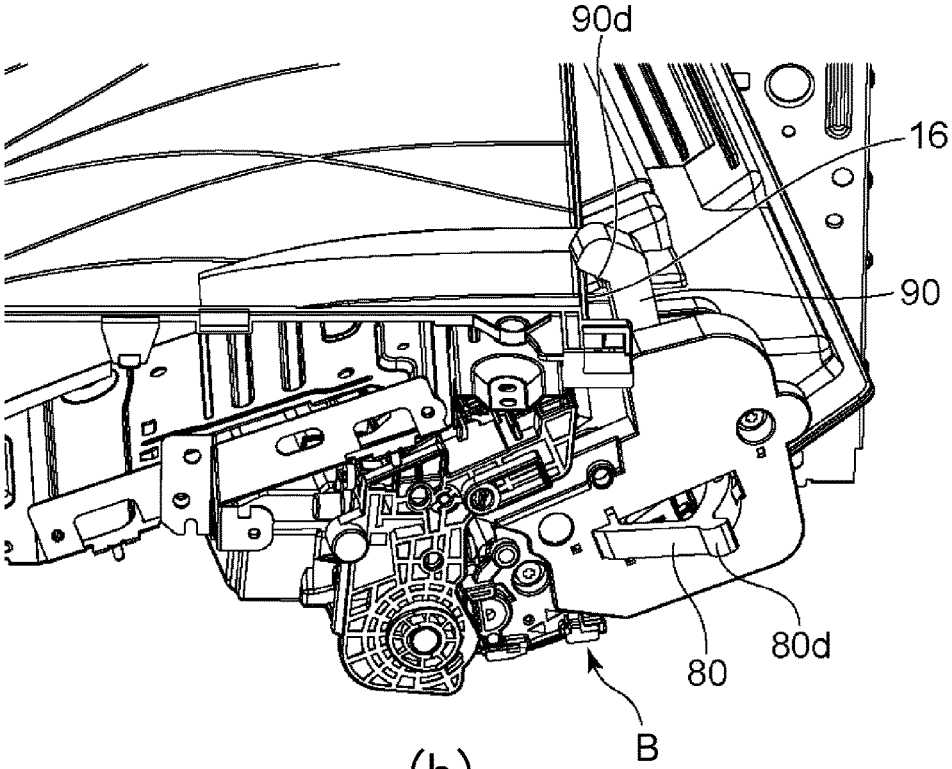
Figure 13:
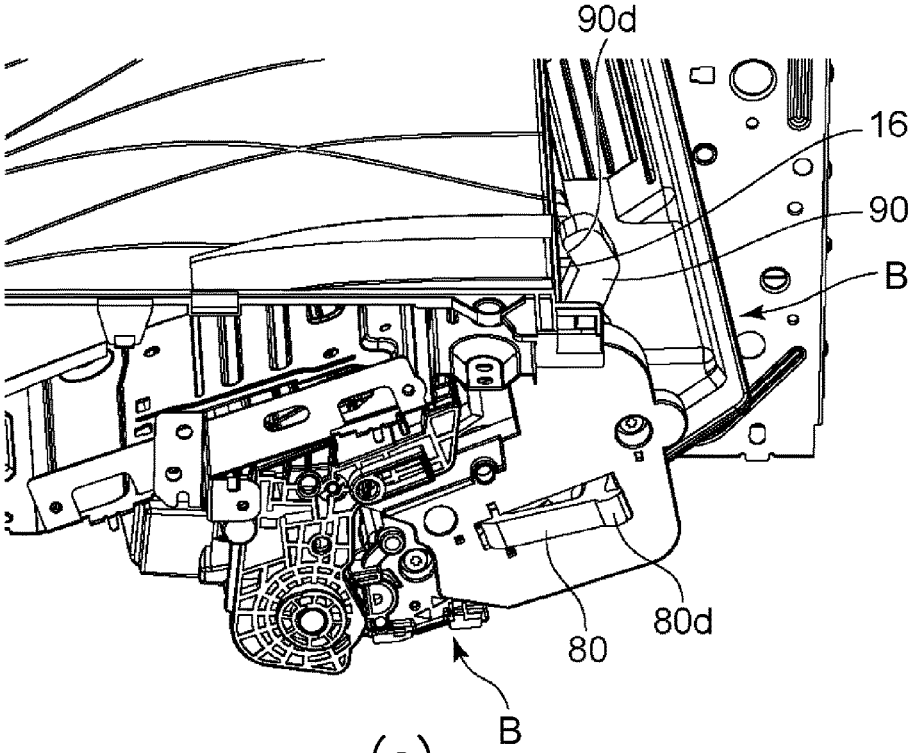
In FIG. 13, part (a) is a perspective view of the neighborhood of the cartridge tilting unit C of the cartridge B as viewed from the non-driving side, and part (b) is a perspective view of the neighborhood of the cartridge tilting unit C of the cartridge B as viewed from the non-driving side.
Figure 13:
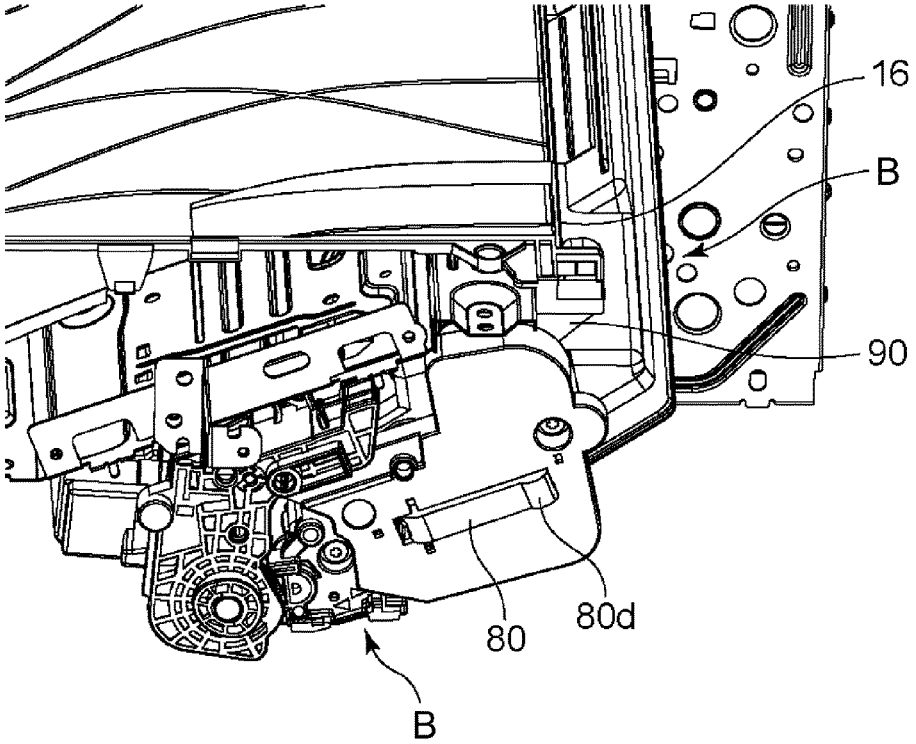
Figure 14:
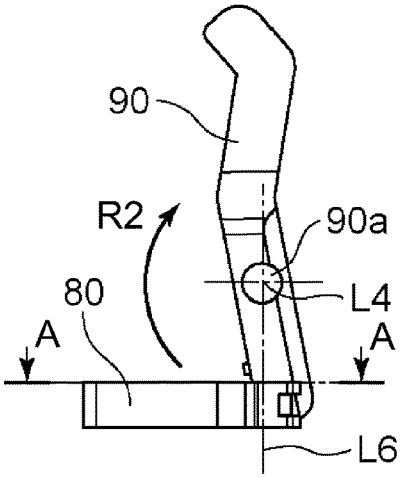
In FIG. 14, part (a) is an illustration showing the relationship between the movable guide member 80 and the regulation lever 90, part (b) is an illustration showing the relationship between the movable guide member 80 and the regulation lever 90, and part (c) is an illustration showing the relationship between the movable guide member 80 and the regulation lever 90, part (d) is an illustration showing the relationship between the movable guide member 80 and the regulating lever 90, part (e) is an illustration showing the relationship between the movable guide member 80 and the regulating lever 90, and part (f) is an illustration showing the relationship between the movable guide member 80 and the regulating lever 90.
Figure 14:
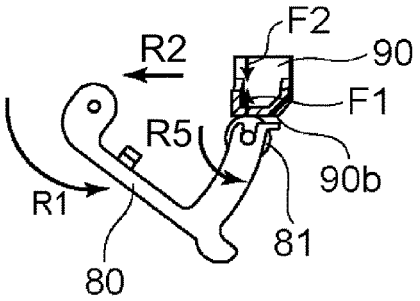
Figure 14:
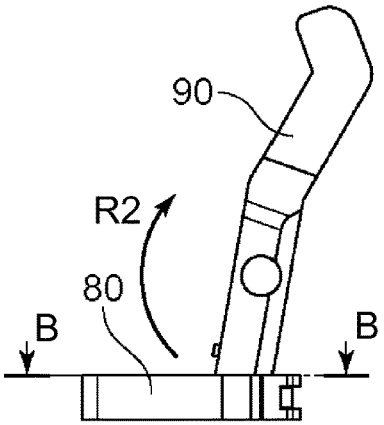
Figure 14:
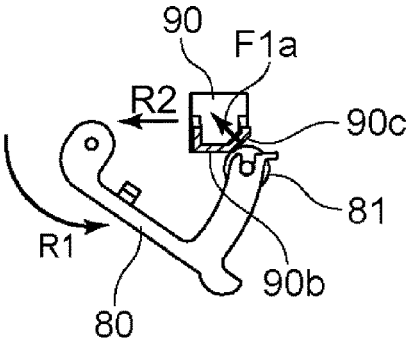
Figure 14:
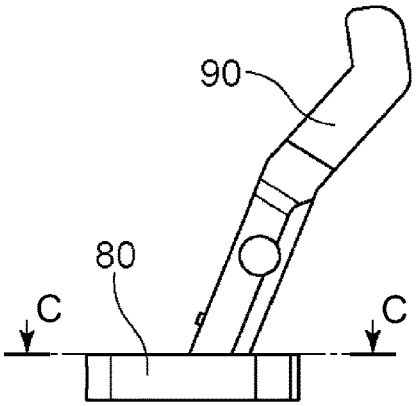
Figure 14:
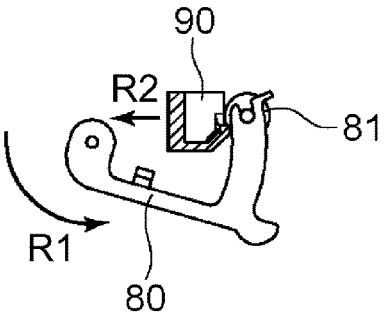

Next, referring to FIGS. 9, 10, 11, 12, 13 and 14, the description will be made as to the operation of the cartridge tilting unit C in the mounting process of mounting the cartridge B on the apparatus main assembly A. Part (a) of FIG. 9, part (b) of FIG. 9, part (a) of FIG. 10 and part (b) of FIG. 10 are top plan views showing the process of mounting the cartridge B in the apparatus main assembly A in the directions perpendicular to the X2 direction and the D direction. Part (a) of FIG. 11, part (b) of FIG. 11 and part (c) of FIG. 11 are top plan views showing the relationship between the coupling member 63 and the main assembly driving shaft 14 in the process of mounting the cartridge B in the apparatus main assembly A, as viewed in the direction perpendicular to the X2 and perpendicular to the D direction. Part (a) of FIG. 12, part (b) of FIG. 12, part (a) of FIG. 13 and part (b) of FIG. 13 are illustrations of the neighborhood of the cartridge tilting unit C of the cartridge B in the process of mounting the cartridge B in the apparatus main assembly A, as viewed from the non-driving side. FIG. 14 is an illustration of the relationship between the movable guide member 80 and the regulation lever 90 in the process of mounting the cartridge B in the apparatus main assembly A. Part (a) of FIG. 14, part (b) of FIG. 14 and part (c) of FIG. 14 are illustrations as viewed from the non-driving side along the axis L4. Part (d) of FIG. 14 is a cross-sectional view taken along a line A-A of part (a) of FIG. 14 as viewed along the axis L3 from the top, and part (e) of FIG. 14 is a cross-sectional view taken along a line B-B of part (b) of FIG. 14 as viewed along the axis L3 from the top, and part (f) of FIG. 14 is a cross-sectional view taken along A-A, and a cross-sectional view taken along B-B, part (f) of FIG. 14 is a cross-sectional view taken along a line C-C of part (c) of FIG. 14 as viewed from above along the axis L3.

Figure 9:
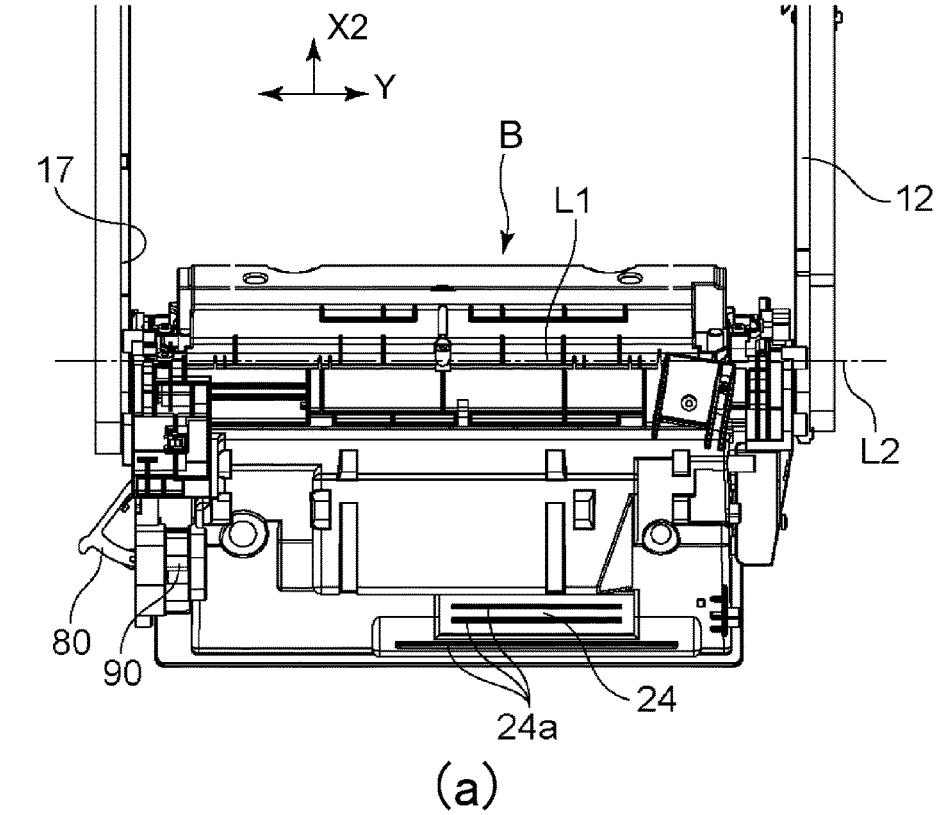
In FIG. 9, part (a) is an upper plan view of the cartridge B and the apparatus main assembly A, and part (b) is an upper plan view of the cartridge B and the apparatus main assembly A.
Figure 9:
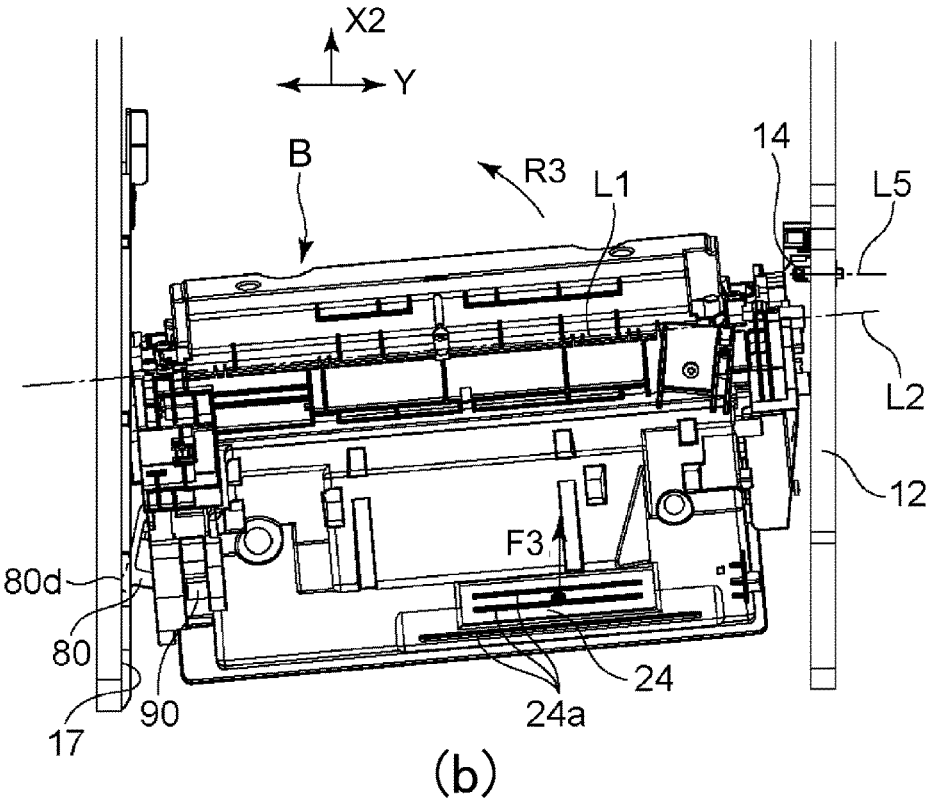

When the user mounts the cartridge B to the apparatus main assembly A, the user inserts the cartridge B, while holding the grip portion 24, and engaging it with the guide portions 12 provided on the drive side and the non-drive side of the apparatus main assembly A, as shown in part (a) of FIG. 9. At this time, the axis L1 is perpendicular to the guide surface 17 of the apparatus main body A, and the cartridge B moves in the X2 direction which is perpendicular to the axis L1. The X2 direction is substantially parallel to the arrangement direction E1 of the rotation centers of the drum 62 and the developing roller 32. The guide surface 17 is perpendicular to the Y direction. At this time, the movable guide member 80 is in the first position. That is, the cartridge tilting unit C is in a projecting state.

As the cartridge B is further inserted, the guided portion 80*d* of the movable guide member comes into contact with the guide surface 17 of the apparatus main assembly A as shown in part (b) of FIG. 9. At this time, as shown in part (a) of FIG. 12, part (a) of FIG. 14 and part (d) of FIG. 14, the regulation lever 90 is in the regulation position. On the other hand, the movable guide member 80 receives a force from the guide surface 17 and receives a force to rotate in the R1 direction around the axis L3, the roller 81 contacts the regulation surface 90*b*, and the regulation surface 90*b* receives a force F1 from the roller 81. The regulation lever 90 contacts to and restricted by the first side cover 25 to receive the reaction force F2, and therefore, it cannot move in the direction of the force F1. Therefore, the movable guide member 80 is restricted from moving to the second position and is maintained in the first position. Therefore, in the cartridge B, by the guided portion 80*d* of the movable guide member 80 contacting the guide surface 17, the axis L1 becomes inclined with respect to the guide surface 17 of the apparatus main assembly A and the Y direction, and as shown in part (a) of FIG. 11, the axis L2 becomes in an inclined state with respect to the axis L5. At this time, as shown in part (b) of FIG. 9, a force F3 imparted by the user inserting the cartridge B while holding the grip portion 24 produces a moment in a direction of rotating the cartridge B in a direction R3 (counterclockwise in part (b) of FIG. 9 about the guided portion 80*d*. Therefore, the cartridge B is inserted into the apparatus main assembly A in a state that the drive side portion of the cartridge B precedes the non-drive side portion in the inserting direction X2.

When the user further inserts the cartridge B into the apparatus main assembly A, the cartridge B moves in the X2 direction while keeping the state in which the axis L1 is inclined with respect to the guide surface 17 of the apparatus main assembly A and the Y direction. Then, as shown in part (b) of FIG. 12, the main assembly contact portion 90*d* of the regulation lever 90 starts contacting the regulation release portion 16 of the device main assembly A. At this time, since the regulation lever 90 is in the regulation position, the movable guide member 80 is maintained in the first position. Further at this time, as shown in part (a) of FIG. 10, the cartridge B is in a state that the axis L1 is inclined with respect to the guide surface 17 and the Y direction. Then, as shown in part (b) of FIG. 11, the coupling member 63 and the main assembly driving shaft 14 come into contact to each other while the axis L2 is inclined with respect to the axis L5, and the movement of the coupling member 63 in the X2 direction is restricted.

When the user further inserts the cartridge B into the device main assembly A, as shown in part (a) of FIG. 13, the main assembly contact portion 90*d* of the regulation lever 90 is in contact with the regulation release portion 16 of the apparatus main assembly A, and therefore, the regulation lever 90 rotates in the R2 direction about the axis L4 toward the non-regulation position. At this time, as shown in part (a) of FIG. 14 and part (d) of FIG. 14, when the regulation surface 90*b* moves in the R2 direction, the roller 81 rotates in R5 direction about the rotational axis L6 (axis L6). As shown in part (a) of FIG. 14, the arrangement is such that when the regulation lever 90 is in the regulation position, as viewed in the direction along the axis L4, an extension line of the axis L6 of the roller 81 overlaps with the supported portion 90*a*, and further with the axis L4, in this embodiment. Therefore, as compared with the structure in which the movable guide member 80 and the regulation surface 90*b* are in direct contact with each other not through the roller 81 with generation of frictional resistance, the above-described structure is effective to reduce the resistance against the movement of the regulation surface 90*b* in the direction R2 produced by the contact between the roller 81 and the regulation surface 90*b*.

As the regulation lever 90 further rotates in the R2 direction, the roller 81 comes into contact with the inclined surface 90*c* as shown in part (b) of FIG. 14 and part (e) of FIG. 14. The inclined surface 90*c* is inclined with respect to the axis L4 of the regulation lever 90 and the surface perpendicular to the axis L4. Therefore, the inclined surface 90*c* receives the force F1*a* from the roller 81, and the component force of the force Fla in the direction parallel to the R2 direction acts on the regulation lever 90 to rotate the regulation lever 90 in the R2 direction. In this manner, the regulating lever 90 comes into contact with the movable guide member 80 and the roller 81 while moving from the regulated position to the non-regulated position.

When the user further inserts the cartridge B into the apparatus main assembly A, the regulation lever 90 is moved to the non-regulated position, and the movable guide member 80 is moved to the second position by way of the states shown in part (c) of FIG. 14 and part (f) of FIG. 14. At this time, the coupling member 63 in is contact with the main assembly driving shaft 14 and is prevented from moving in the X2 direction. Therefore, as shown in part (a) of FIG. 10, the cartridge B rotates in the R4 direction about the contact portion between the main assembly driving shaft and the coupling member 63 by the force F3 applied to the grip portion 24 by the user (clockwise direction in part (a) of FIG. 10). By this rotation, the coupling member 63 is brought into engagement with the main assembly driving shaft 14 while circumventing it.

Finally, as shown in part (b) of FIG. 10 and part (b) of FIG. 13, the axis L1 of the cartridge B becomes perpendicular to the guide surface 17 of the apparatus main assembly A and parallel to the Y direction. The cartridge tilting unit C becomes in the retracted state. At this time, as shown in part (c) of FIG. 11, the axis L2 is coaxial (parallel) with the axis L5, and the coupling member 63 and the main assembly driving shaft 14 are engaged with each other. This completes the mounting of the cartridge B in the device main assembly A.

<Dismounting of Cartridge B from Apparatus Main Assembly A>

In the removal step of dismounting the cartridge B from the apparatus main assembly A, the above-described mounting steps are carried out in the reverse order. When the cartridge B changes from the state shown in part (b) of FIG. 10 to the state shown in part (b) of FIG. 10, the movable guide member 80 moves from the second position to the first position by the urging force of the first spring 85. By this, the regulating lever 90 rotates from the non-regulated position shown in part (b) of FIG. 7 to the regulated position shown in part (a) of FIG. 7 by the urging force of the second spring 95 in the direction opposite to the R2 direction. By this, the cartridge tilting unit C returns to the projecting state.

As shown in part (a) of FIG. 7 and part (b) of FIG. 7, a direction E2 is defined as the direction perpendicular to the direction E1 in which the rotation center of the drum 62 and the rotation center of the developing roller 32 are aligned as viewed along the axis L4. The portion of the lever 90 projecting from the first side cover 25 is a projecting portion 90*g*. The second spring 95 for urging the regulation lever 90 is a tension coil spring stretched between the spring contact portion 90*e* and the second spring locking portion 26*e*, and the central axis of the coil is not parallel to the axis L4 (in a twisted relation).

Further, as viewed along the axis L4, with respect to the direction E2, the spring contact portion 90*e* and the second spring locking portion 26*e* are located on the opposite side of the main assembly contact portion 90*d* and the projecting portion 90*g* with respect to the supported portion 90*a* (axis line L4). In addition, as viewed along the axis L4, the spring contact portion 90*e* and the second spring locking portion 26*e* are located on the opposite side of the main assembly contact portion 90*d* and the projecting portion 90*ge* with respect to the supported portion 90*a* (axis line L4), in the Z direction (direction parallel to the axis L3).

With the above-described structure of the second spring 95 and the arrangement of the spring contact portion 90*e* and the second spring locking portion 26*e*, the urging force of the second spring 95 can be assuredly caused to act on the regulation lever 90 during the regulating lever 90 moving from the non-regulated position to the regulated position.

As described above, according to this embodiment, the mountability of the cartridge B can be improved in the structure in which the cartridge B is mounted on the apparatus main assembly A while inclining the axis L1.

Specifically, the center line CH of the grip portion 24 in the D direction is on the coupling member 63 side (driving side) with respect to the center line C1 and the center line C2 of the cartridge B in the D direction in both the projecting state and the retracted state. By this, when the cartridge B is inserted, it is possible to more reliably create a state in which the axis L1 shown in FIG. 9*sf*(*b*) is inclined with respect to the Y direction. In addition, as shown in FIG. 8, the grip portion 24 is arranged so that the central position CH is in the width W range in the D direction in both the projecting state and the retracted state. By this, it is possible to prevent the axis L1 from being tilted more than necessary with respect to the Y direction when the cartridge B is inserted.

Further, in the case that the movable guide member 80 and the regulation surface 90*b* are in direct contact with each other to generate frictional resistance without providing the roller 81, the regulation lever 90 is sandwiched between the movable guide member 80 and the first side cover 25 with the result of the production of a frictional forces relative to the two members. In the case of such a structure, there is a possibility that it cannot rotate smoothly in the R2 direction. However, by providing the roller 81 at the portion of the movable guide member 80 which contacts the regulation lever 90, the roller 81 in contact with the regulation surface 90*b* can rotate in the R5 direction while the regulation lever 90 is rotating from the regulated position to the non-regulation position in the R2 direction. Therefore, the resistance of the movement (rotation) of the regulation lever 90 can be reduced, and the regulation lever 90 can be smoothly moved (rotated) from the regulated position to the non-regulated position.

Further, by providing the regulating lever 90 with the inclined surface 90*c*, the force received by the movable guide member 80 from the guide surface 17 to move the movable guide member 80 from the first position to the second position is effective to cause the regulating lever 90 to move in the R2 direction. By this, the rotation (movement) of the regulation lever 90 from the regulated position to the non-regulated position in the R2 direction can be performed more smoothly.

Embodiment 2

Figure 15:
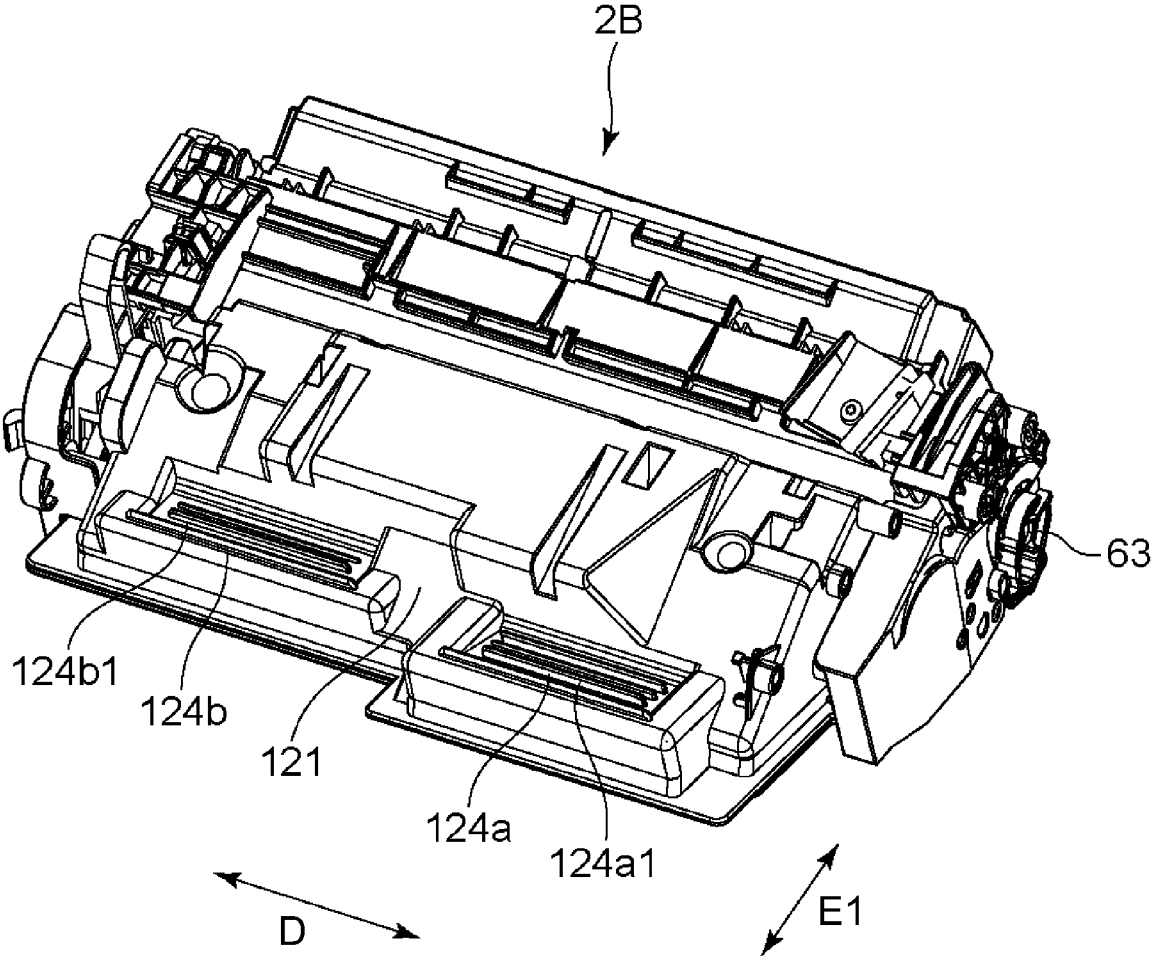
FIG. 15 is a perspective view of the cartridge 2B.

Next, Embodiment 2 of the present invention will be described. In the description of this embodiment, the description of the portions common to the Embodiment 1 will be omitted. In this embodiment, the structure of the grip portion provided on the cartridge 2B is different from that of the Embodiment 1, and in the other respects, it is the same as the cartridge B of the Embodiment 1. FIG. 15 is a perspective view of the cartridge 2B, and part (a) of FIG. 16 and part (b) of FIG. 16 are top plan views of the cartridge 2B as viewed along the directions perpendicular to the X2 direction and the D direction.

A toner accommodating container 121 of the cartridge 2B has a first grip portion 124*a* and a second grip portion 124*b*. Each of the first grip portion 124*a* and the second grip portion 124*b* includes a first non-slip portion 124*a*1 and a second non-slip portion 124*b*1 functioning as anti-slip portion when gripped by the user. The first non-slip portion 124*a*1 and the second non-slip portion 124*b*1 each comprises a plurality of ribs or grooves extending in the D direction.

The first grip portion 124*a* and the second grip portion 124*b* are arranged at different positions in the D direction, and the first grip portion 124*a* is placed closer to the driving side end where a coupling member 63 of the cartridge B is provided than the second grip portion 124*b*. Further, as shown in FIG. 16, when comparing the distances H1 and H2 from the axis L1 to the first grip portion 124*a* and the second grip portion 124*b* with respect to the inserting direction X2 (or E1 direction) of the cartridge 2B, the distance H1 is longer than the distance H2. That is, in the X2 direction (or the E1 direction), the first grip portion 124*a* is at a position more remote from the axis L1 than the second grip portion 124*b*.

Figure 16:
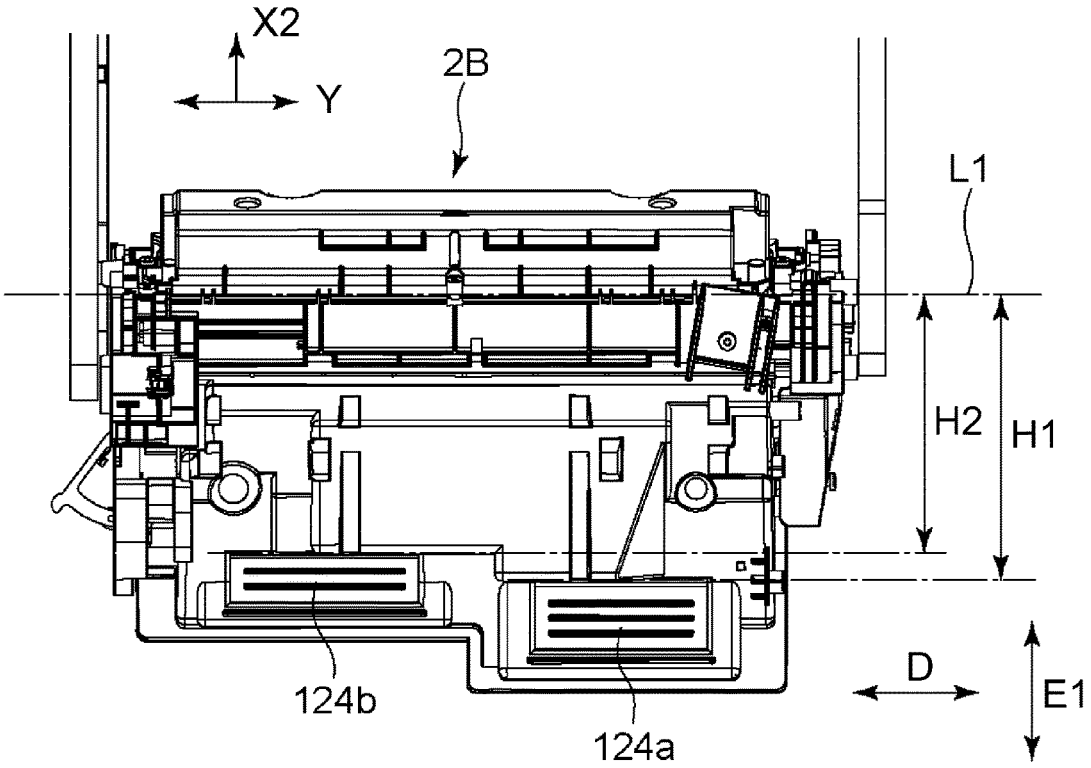
In FIG. 16, part (a) is a top view of the cartridge 2B, and part (b) is a top view of the cartridge 2B.
Figure 16:
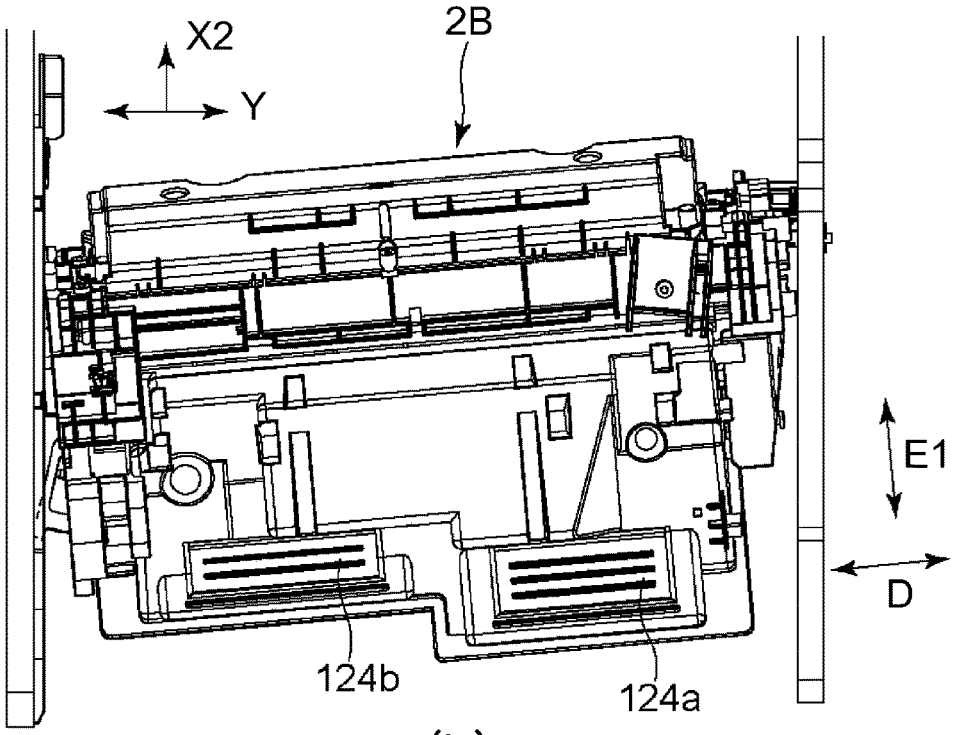

Therefore, when the cartridge 2B is started to be inserted into the apparatus main assembly A in the X2 direction as shown in part (a) of FIG. 16, the first grip portion 124*a* is on the upstream side of the second grip portion 124*b* in the X2 direction. By this, the user can be more likely to grip the first grip portion 124*a* which is closer to himself or herself than the second grip portion 124*b* and to insert the cartridge B. A moment in the direction of rotating the cartridge 2B in the R3 direction (counterclockwise direction in FIG. 9B) about the guided portion 80*d* is produced by the force F3 applied by the user to insert the cartridge 2B while holding the first grip portion 124*a*. Therefore, the cartridge 2B is inserted into the apparatus main assembly A in a state in which the drive-side portion of the cartridge 2B precedes the non-drive-side portion in the inserting direction X2, that is, in a state where the axis L1 is inclined with respect to the axis L2.

Then, as shown in part (b) of FIG. 16, the coupling member 63 is brought into contact to the main assembly driving shaft 14 while the axis L2 is inclined with respect to the axis L5, the movement of the coupling member 63 in the X2 direction is restricted, similarly to the case of part (a) of FIG. 10. Thereafter, the user grips the second grip portion 124*b* and inserts the cartridge 2B, so that the cartridge 2B rotates in the R4 direction about the contact portion between the main body driving shaft 14 and the coupling member 63. Through such an operation, the cartridge 2B can be completely mounted in the apparatus main assembly A.

In this embodiment described above, the structure in which the first grip portion 124*a* and the second grip portion 124*b* are provided apart from each other has been described, but the present invention is not limited to this example. That is, a portion of the first grip portion 124*a* and a portion of the second grip portion 124*b* may be common. The structure in which portions of the two grip portions are common means a structure in which a specific portion of the surface of the toner accommodating container 121 is a portion of the first grip portion 124*a* and also a portion of the second grip portion 124*b*. In such a case, it will suffice if at least a portion of the first grip portion 124*a* may have a portion arranged upstream of the second grip portion 124*b*, with respect to the inserting direction X2.

Further, in the above-described embodiment, at least a portion of the first grip portion 124*a* has a portion arranged upstream of the second grip portion 124*b*, with respect to the inserting direction X2, but the present invention is not limited to such an example. That is, if a portion of the first grip portion 124*a* and a portion of the second grip portion 124*b* are not common, it will suffice if at least a portion of the first grip portion 124*a* does not have a portion upstream of the second grip portion 124*b* in the inserting direction X2. Such an arrangement of the grip portions includes an arrangement in which there is no provision of any one of the first grip portion 124*a* and the second grip portion 124*b* in the E1 direction, and the examples of such a structure is shown in the first grip portion 224*a* and the second grip portion 224*b* in FIG. 17.

Further, in the above-described embodiment, the plurality of ribs or grooves provided in the first non-slip portion 124*a*1 and the second non-slip portion 124*b*1 each have a shape extending in the D direction, but the present invention is not limited to such an example. For example, the extending directions of the plurality of ribs or grooves provided in the first nonslip portion 124*a*1 and the second non-slip portion 124*b*1 may be different from each other. Specifically, the extending direction of the plurality of ribs or grooves of the first nonslip portion 124*a*1 may be the direction inclined in the D direction, and the extending direction of the plurality of ribs or grooves of the second non-slip portion 124*b*11 may be the D direction. By doing so, it is easy to inform the user that the first grip portion 124*a* and the second grip portion 124*b* are gripped at different timings of the cartridge attitude.

As described above, by providing the first grip portion 124*a* and the second grip portion 124*b*, the mountability of the cartridge 2B can be improved in the structure in the cartridge B is mounted in the apparatus main assembly A with the axis L1 tilted.

Embodiment 3

Figure 17:
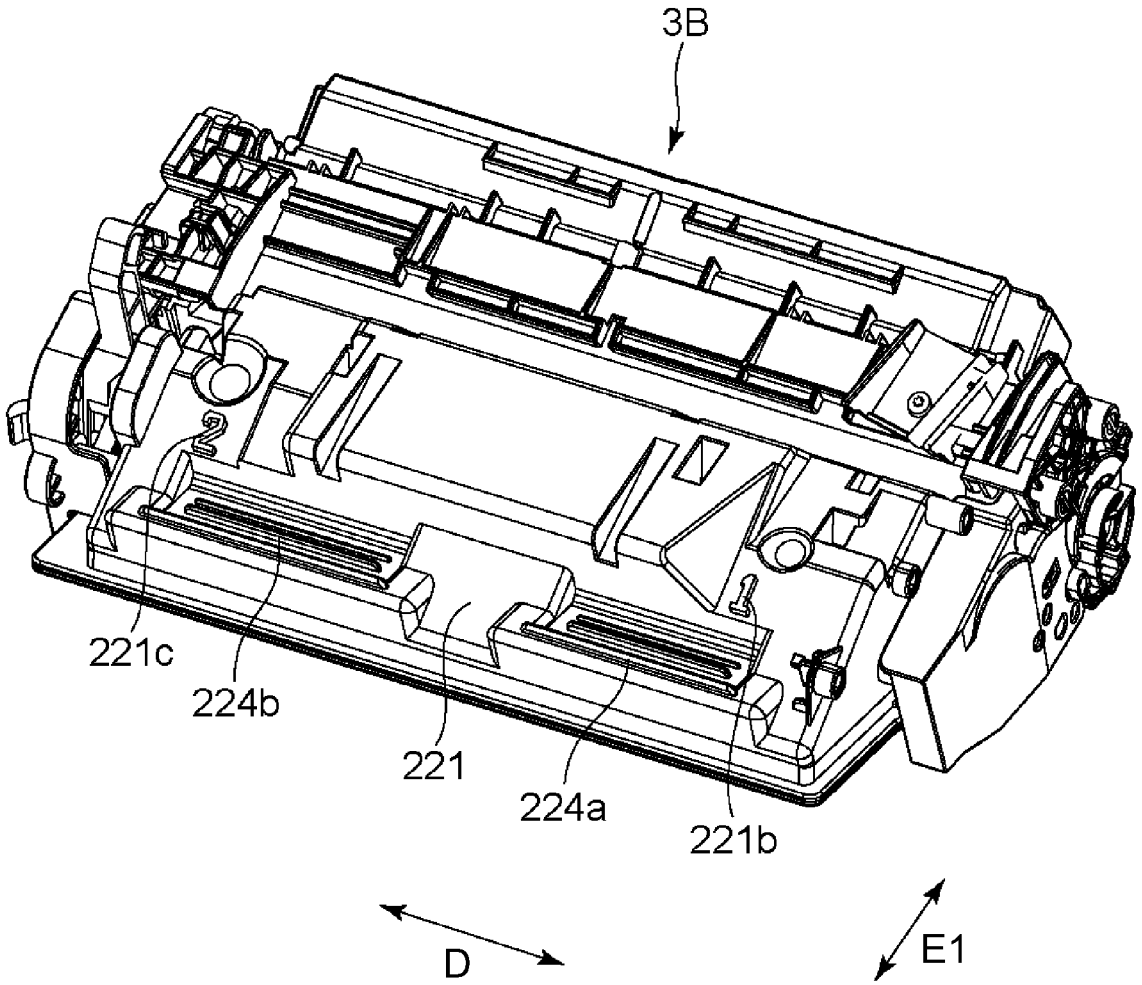
FIG. 17 is a perspective view of the cartridge 3B.

Next, Embodiment 3 of the present invention will be described. In the description of the present embodiment, the description of the portions common to the Embodiment 1 and the Embodiment 2 will be omitted. In this embodiment, the structure of the grip portion provided on the cartridge 3B is different from that in the Embodiment 2, and in the other respects, it is the same as the cartridge 2B in the Embodiment 2. FIG. 17 is a perspective view of the cartridge 3B.

In this embodiment, as shown in FIG. 17, the toner accommodating container 221 includes a display portion which indicates to the user the order in which the first grip portion 224*a* and the second grip portion 224*b* are gripped. Specifically, the first display portion 221*b* is provided near the first grip portion 224*a*, and the second display portion 221*c* is provided near the second grip portion 224*b*. Therefore, when the cartridge 3B is mounted to the device main body, the user can be guided to first grip the first grip portion 224*a*. This makes it easier for the user to insert the cartridge 3B in a state in which the drive-side portion of the cartridge 3B precedes the non-drive-side portion in the inserting direction X2 (that is, the axis L1 is inclined with respect to the axis L2).

Then, as in part (b) of FIG. 16, while the axis L2 is inclined with respect to the axis L5, the coupling member 63 and the main assembly driving shaft 14 are brought into contact with each other, and the movement of the coupling member 63 in the X2 direction is restricted, and thereafter, it is possible to induce the user to grip the second grip portion 224*b*. By this, the cartridge 2B can be completely mounted on the device main assembly A by rotating in the R4 direction about the contact portion between the main assembly driving shaft 14 and the coupling member 63.

The first display unit 221*b* may have at least a portion thereof arranged on the first grip portion 224*a*, and the second display unit 221*c* may have at least a portion thereof arranged on the second grip portion 224*b*. Further, the characters displayed by the first display portion 221*b* and the second display portion 221*c* are not limited to Arabic numerals as long as they can indicate the order of gripping, but other numbers (Roman numerals, for example) and characters or symbols indicating the order ("FIRST" and other words, sentences or the like).

As described above, the display portions (first display portion 221*b* and second display portion 221*c*) will suffice if it indicates to the user the order in which the first grip portion 224*a* and the second grip portion 224*b* are gripped. Further, unlike the first display portion 221*b* and the second display portion 221*c*, they may not be arranged apart from each other and may be displayed together in one place.

Further, the display method of the first display portion 221*b* and the second display portion 221*c* is not limited to the examples in which characters are three-dimensionally formed on the surface of the toner accommodating container 221 by pits or projections. For example, a sticker or member on which characters are printed may be mounted or fixed to the surface of the toner accommodating container 221, it may be marked with ink or the like, or may be engraved with a laser or an engraving tool.

Further, in the above-described embodiments, the structure in which the first grip portion 224*a* and the second grip portion 224*b* are provided apart from each other has been described, but the structure of the first grip portion 224*a* and the second grip portion 224*b* is not limited to such an example. That is, a portion of the first grip portion 224*a* and a portion of the second grip portion 224*b* may be common. That is, a specific portion of the surface of the toner accommodating container 221 may be a portion of the first grip portion 224*a* and also a portion of the second grip portion 224*b*. Further, one grip portion including a portion on the drive side (corresponding to the first grip portion 224*a*) and a portion on the non-drive side (corresponding to the second grip portion 224*b*) with respect to the center position C1 (not shown) and the center position C2 (not shown) in the D direction. That is, even when one grip portion has a portion corresponding to the first grip portion 224*a* and the second grip portion 224*b*, it can be said that the structure has the first grip portion 224*a* and the second grip portion 224*b*. The center position C1 and the center position C2 in this embodiment have the same definitions as those in Embodiment 1.

As described above, in this embodiment, two grip portions (first grip portion 224*a*, second grip portion 224*b*) are provided, and display portions (first display portion 221*b*, second display portion 221*c*) corresponding to them are provided. By this, in the structure in which the cartridge B is mounted on the apparatus main assembly A by inclining the axis L1, the mountability of the cartridge 2B can be improved.

Further, the first display portion 221*b* and the second display portion 221*c* of the present embodiment may be added to the structure of Embodiment 2.

Further, the cartridge B described in each of Embodiments 1-3 has a structure including a drum 62 and a coupling member 63 for transmitting a driving force to the drum 62, but the structure of the cartridge B and the object to receive the driving force through the coupling member 63 is not limited to the drum 62.

That is, the cartridge B may not have the drum 62, or the coupling member 63 may not transmit the driving force to the drum 62 but transmit the driving force to the developing roller 32 or the like.

INDUSTRIAL APPLICABILITY

According to the present invention, there is provided a cartridge which can be mounted to or dismounted from an electrophotographic image forming apparatus, which represents further development of the prior art.

The present invention is not limited to the above-described embodiment, and various modifications and modifications can be made without departing from the spirit and scope of the present invention.

Therefore, the following claims are provided in order to publicize the scope of the present invention.

This application claims priority on the basis of Japanese Patent Application Japanese Patent Application No. 2018-120285 filed on Jun. 25, 2018 and Japanese Patent Application No. 2019-115774 filed on Jun. 21, 2019. All of the contents of them are incorporated here.

The invention claimed is:

1. A cartridge comprising:

a photosensitive drum;

a coupling member for transmitting a driving force to the photosensitive drum;

a frame rotatably supporting the photosensitive drum;

a movable member movable relative to the frame;

a rotatable portion supported by the movable member and rotatable relative to the movable member; and a regulating member movable between a regulating position for regulating movement of the movable member by contacting the rotatable portion and a non-regulating position where the regulating member does not regulate the movable member, wherein a position of an end portion of the movable member in an axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, and wherein, when the regulating member is in the regulating position, the movable member is constrained from moving from the first position to the second position, and, when the regulating member is in the non-regulating position, the movable member is permitted to move from the first position to the second position.

2. A cartridge according to claim 1, wherein the rotatable portion is rotatable while being in contact with the regulating member moving from the regulating position toward the non-regulating position.

3. A cartridge according to claim 1, wherein the regulating member moves between the regulating position and the non-regulating position by rotation thereof.

4. A cartridge according to claim 3, further comprising a developing roller for supplying toner to the photosensitive drum, and a spring for moving the regulating member from the non-regulating position to the regulating position, wherein the regulating member is provided with an urged portion urged by the spring and a projected portion projected from the frame, and wherein, as viewed along a direction of a rotational axis of the regulating member, the urged portion is positioned on a side opposite from the projected portion with respect to the rotational axis of the regulating member in a direction perpendicular to a direction in of a rotational axis of the photosensitive drum and a rotational axis of the developing roller.

5. A cartridge according to claim 4, wherein the spring is a tension coil spring.

6. A cartridge according to claim 5, wherein the tension coil spring has a center axis that is not parallel to a rotational axis of the regulating member.

7. A cartridge according to claim 3, wherein the regulating member has a first surface contacting the movable member when the regulating member is in the regulating position, and a second surface contacting the movable member in midstream of movement from the regulating position to the non-regulating position, and wherein the first surface is substantially perpendicular a rotational axis of the regulating member, and the second surface is inclined relative to the first surface and the rotational axis of the regulating member.

8. A cartridge according to claim 1, wherein the cartridge is mountable to an image forming apparatus, and the coupling member is positioned closer to one end portion of the frame than to the other end portion in an axial direction of the photosensitive drum, wherein the frame is provided with a grip portion to be gripped when the cartridge is mounted to the image forming apparatus, and wherein a center of the grip portion is closer to the one end portion than to the other end potion of the frame.

9. A cartridge according to claim 1, wherein the cartridge is mountable to an image forming apparatus, and the cartridge includes a developing roller for carrying toner to be supplied to the photosensitive drum, wherein the coupling member is positioned closer to one end portion of the frame than to the other end portion in an axial direction of the photosensitive drum, wherein the frame is provided with a first grip portion and a second grip portion to be gripped when the cartridge is mounted to the image forming apparatus, wherein the first grip portion is positioned closer to the one end portion than the second grip portion, and wherein the first grip portion is positioned more remote from an axis of the photosensitive drum than the second grip portion in a direction in which a rotational axis of the photosensitive drum and a rotational axis of the developing roller are arranged.

10. A cartridge according to claim 9, wherein the frame is provided with a display portion indicative of an order of gripping the first grip portion and the second grip portion.

11. A cartridge according to claim 1, wherein the cartridge is mountable to an image forming apparatus, and the coupling member is positioned closer to one end portion of the frame than to the other end portion in an axial direction of the photosensitive drum, wherein the frame is provided with a first grip portion and a second grip portion to be gripped when the cartridge is mounted to the image forming apparatus, wherein the first grip portion is positioned closer to the one end portion than the second grip portion, and wherein the frame is provided with a display portion indicative of an order of gripping the first grip portion and the second grip portion.

12. A cartridge according to claim 1, wherein the coupling member is positioned closer to the one end portion than to the other end portion of the frame in the axial direction, and the end portion of the movable member is positioned closer to the other end portion than to the one end portion in the axial direction.

13. A cartridge mountable to an image forming apparatus, the cartridge comprising:

a photosensitive drum;

a coupling member for transmitting a driving force to the photosensitive drum;

a frame rotatably supporting the photosensitive drum;

a grip portion to be gripped when the cartridge is mounted to the image forming apparatus;

a movable member movable relative to the frame; and a regulating member movable between a regulating position for regulating movement of the movable member by contacting the movable member and a non-regulation position where the regulating member does not regulate the movable member;

wherein the coupling member is positioned closer to one end portion of the cartridge than to the other end portion of the cartridge in an axial direction of the photosensitive drum, wherein a position of an end portion of the movable member in the axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, wherein, when the regulating member is in the regulating position, the movable member is constrained from moving from the first position to the second position, and, when the regulating member is in the non-regulating position, the movable member is permitted to move from the first position to the second position, and wherein, when the movable member is in the second position, a center of the grip portion is positioned closer to the one end of the cartridge portion than to the other end portion of the cartridge in the axial direction of the photosensitive drum.

14. A cartridge according to claim 13, wherein when the movable member is in the second position the grip portion is positioned such that a center position of the cartridge is in a width of the grip portion with respect to the axial direction of the photosensitive drum.

15. A cartridge according to claim 13, wherein the frame includes a toner accommodating container for accommodating toner, and the grip portion is provided on the toner accommodating container.

16. A cartridge according to claim 13, wherein the frame is provided with a recess on an outer surface thereof, and the grip portion includes at least a part of the recess.

17. A cartridge according to claim 13, wherein a surface of the frame that constitutes the grip portion is provided with a non-slip shape portion.

18. A cartridge according to claim 13, wherein a surface of the frame that constitutes the grip portion is provided with a plurality of linear ribs.

19. A cartridge according to claim 13, wherein the movable member is rotatable between the first position and the second position.

20. A cartridge according to claim 13, wherein the regulating member is rotatable between the regulating position and the non-regulating position.

21. A cartridge mountable to an image forming apparatus, the cartridge comprising:

a photosensitive drum;

a coupling member for transmitting a driving force to the photosensitive drum;

a frame rotatably supporting the photosensitive drum;

a grip portion to be gripped when the cartridge is mounted to the image forming apparatus;

a movable member movable relative to the frame; and a regulating member movable between a regulating position for regulating movement of the movable member by contacting the movable member and a non-regulating position where the regulating member does not regulate the movable member, wherein the coupling member is positioned closer to one end portion of the frame than the other end portion of the frame in an axial direction of the photosensitive drum, wherein a position of an end portion of the movable member in the axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, wherein, when the regulating member is in the regulating position, the movable member is constrained from moving from the first position to the second position, and, when the regulating member is in the non-regulating position, the movable member is permitted to move from the first position to the second position, and wherein, when the movable member is in the second position, a center of the grip portion is positioned closer to the one end portion of the frame than to the other end portion of the frame in the axial direction of the photosensitive drum.

22. A cartridge according to claim 21, wherein when the movable member is in the second position the grip portion is positioned such that a center position of the cartridge is in a width of the grip portion with respect to the axial direction of the photosensitive drum.

23. A cartridge according to claim 21, wherein the frame includes a toner accommodating container for accommodating toner, and the grip portion is provided on the toner accommodating container.

24. A cartridge according to claim 21, wherein the frame is provided with a recess on an outer surface thereof, and the grip portion includes at least a part of the recess.

25. A cartridge according to claim 21, wherein a surface of the frame that constitutes the grip portion is provided with a non-slip shape portion.

26. A cartridge according to claim 21, wherein a surface of the frame that constitutes the grip portion is provided with a plurality of linear ribs.

27. A cartridge according to claim 21, wherein the movable member is rotatable between the first position and the second position.

28. A cartridge according to claim 21, wherein the regulating member is rotatable between the regulating position and the non-regulating position.

29. A cartridge mountable to an image forming apparatus, the cartridge comprising:

a photosensitive drum;

a coupling member for transmitting a driving force to the photosensitive drum;

a frame rotatably supporting the photosensitive drum;

a grip portion to be gripped when the cartridge is mounted to the image forming apparatus;

a movable member movable relative to the frame; and a regulating member movable between a regulating position for regulating movement of the movable member by contacting the movable member and a non-regulating position where the regulating member does not regulate the movable member, wherein the coupling member is positioned closer to one end portion of the photosensitive drum than to the other end portion of the photosensitive drum in an axial direction of the photosensitive drum, wherein a position of an end portion of the movable member in the axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, wherein, when the regulating member is in the regulating position, the movable member is constrained from moving from the first position to the second position, and, when the regulating member is in the non-regulating position, the movable member is permitted to move from the first position to the second position, and wherein, when the movable member is in the second position, a center of the grip portion is positioned closer to the one end portion of the photosensitive drum than to the other end portion of the photosensitive drum in the axial direction of the photosensitive drum.

30. A cartridge according to claim 29, wherein when the movable member is in the second position the grip portion is positioned such that a center position of the photosensitive drum is in a width of the grip portion with respect to the axial direction of the photosensitive drum.

31. A cartridge comprising:

a photosensitive drum;

a developing roller for supplying toner to the photosensitive drum, a coupling member for transmitting a driving force to the photosensitive drum;

a frame rotatably supporting the photosensitive drum;

a movable member movable relative to the frame;

a regulating member including an urged portion and a projected portion projected from the frame, the regulating member being rotatable between a regulating position for regulating movement of the movable member by contacting the movable member and a non-regulating position where the moveable member does not regulate the movable member, a spring for urging the urged portion to move the regulating member from the non-regulating position to the regulating position, wherein a position of an end portion of the movable member in an axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, wherein, when the regulating member is in the regulating position, the movable member is constrained from moving from the first position to the second position, and, when the regulating member is in the non-regulating position, the movable member is permitted to move from the first position to the second position, and wherein, as viewed along a direction of a rotational axis of the regulating member, the urged portion is positioned on a side opposite from the projected portion with respect to a rotational axis of the regulating member in a first direction perpendicular to a direction in which a rotational axis of the photosensitive drum and a rotational axis of the developing roller extend.

32. A cartridge comprising:

a photosensitive drum;

a coupling member for transmitting a driving force to the photosensitive drum;

a frame rotatably supporting the photosensitive drum;

a movable member movable relative to the frame; and a regulating member rotatable between a regulating position for regulating movement of the movable member by contacting the movable member and a non-regulating position where the moveable member does not regulate the movable member, wherein a position of an end portion of the movable member in an axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, wherein, when the regulating member is in the regulating position, the movable member is constrained from moving from the first position to the second position, and, when the regulating member is in the non-regulating position the movable member is permitted to move from the first position to the second position, wherein the regulating member has a first surface contacting the movable member when the regulating member is in the regulating position, and a second surface contacting the movable member in midstream of movement from the regulating position to the non-regulating position, and wherein the first surface is substantially perpendicular a rotational axis of the regulating member, and the second surface is inclined relative to the first surface and the rotational axis of the regulating member.

33. A cartridge mountable to an image forming apparatus, the cartridge comprising:

a photosensitive drum;

a coupling member for transmitting a driving force to the photosensitive drum;

a frame rotatably supporting the photosensitive drum;

a developing roller for carrying toner to the photosensitive drum;

a movable member movable relative to the frame; and a regulating member movable between a regulating position for regulating movement of the movable member by contacting the movable member and a non-regulating position where the moveable member does not regulate the movable member, wherein a position of an end portion of the movable member in an axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, and wherein, when the regulating member is in the regulating position the movable member is constrained from moving from the first position to the second position, and, when the regulating member is in the non-regulating position, the movable member is permitted to move from the first position to the second position, wherein the coupling member is disposed at a position closer to one end portion of the frame than to the other end portion in the axial direction of the photosensitive drum, wherein the frame is provided with a first grip portion and a second grip portion to be gripped when the cartridge is mounted to the image forming apparatus, wherein the first grip portion is positioned closer to the one end portion than the second grip portion, and wherein the first grip portion is positioned more remote from a rotational axis of the photosensitive drum than the second grip portion in a direction in which the rotational axis of the photosensitive drum and a rotational axis of the developing roller are arranged.

34. A cartridge mountable to an image forming apparatus, the cartridge comprising:

a photosensitive drum;

a coupling member for transmitting a driving force to the photosensitive drum;

a frame rotatably supporting the photosensitive drum;

a movable member movable relative to the frame; and a regulating member movable between a regulating position for regulating movement of the movable member by contacting the movable member and a non-regulating position where the moveable member does not regulate the movable member;

wherein a position of an end portion of the movable member in an axial direction of the photosensitive drum changes relative to the frame by movement of the movable member between a first position and a second position, and the end portion of the movable member is closer to the coupling member in the axial direction of the photosensitive drum when the movable member is in the second position than when the movable member is in the first position, wherein, when the regulating member is in the regulating position, the movable member is constrained from moving from the first position to the second position, and, when the regulating member is in the non-regulating position, the movable member is permitted to move from the first position to the second position, wherein the coupling member is positioned closer to one end portion of the frame than to the other end portion in the axial direction of the photosensitive drum, wherein the frame is provided with a first grip portion and a second grip portion to be gripped when the cartridge is mounted to the image forming apparatus, wherein the first grip portion is positioned closer to the one end portion than the second grip portion, and wherein the frame is provided with a display portion indicative of an order of gripping the first grip portion and the second grip portion.

35. A cartridge mountable to an image forming apparatus, the cartridge comprising:

a photosensitive drum;

a developing roller;

a coupling member for transmitting a driving force to the photosensitive drum;

a first frame rotatably supporting the photosensitive drum;

a second frame connected to the first frame and rotatably supporting the developing roller;

a grip portion to be gripped when the cartridge is mounted to the image forming apparatus, the grip portion being provided on the second frame;

wherein the coupling member is positioned closer to one end portion of the cartridge than to the other end portion of the cartridge in an axial direction of the photosensitive drum, wherein the second frame includes a side surface positioned at the one end portion of the cartridge and the side surface has an inclined surface that is inclined with respect to a plane perpendicular that is to a rotational axis of the photosensitive drum so that a distance from the other end portion of the cartridge along the rotational axis of the photosensitive drum decreases as a distance from the coupling member along a direction perpendicular to the rotational axis of the photosensitive drum increases and a distance from the grip portion along the direction perpendicular to the rotational axis of the photosensitive drum decreases, and wherein a center of the grip portion is positioned closer to the one end portion of the cartridge than to the other end portion of the cartridge in the axial direction of the photosensitive drum.

36. A cartridge according to claim 35, wherein the second frame includes a toner accommodating container for accommodating toner, and the grip portion is provided on the toner accommodating container.

37. A cartridge according to claim 36, wherein a surface of the second frame that constitutes the grip portion is provided with a plurality of linear ribs.

38. A cartridge according to claim 35, wherein the second frame includes a toner accommodating container for accommodating toner and a side cover attached to the toner accommodating container at the one end portion of the second frame, and wherein the side cover is provided with the side surface.

39. A cartridge according to claim 38, wherein the grip portion is provided on the toner accommodating container.

40. A cartridge according to claim 35, wherein the second frame is provided with a recess on an outer surface thereof, and the grip portion includes at least a part of the recess.

41. A cartridge according to claim 35, wherein a surface of the second frame that constitutes the grip portion is provided with a non-slip shape portion.

* * * * *